US005101880A

United States Patent [19]

Fujiwara et al.

[11] Patent Number: 5,101,880

[45] Date of Patent: Apr. 7, 1992

[54] FLASKLESS CASTING LINE

[75] Inventors: Yoshikazu Fujiwara; Eiichi Tomita; Hiroshi Inoguchi, all of Toyota, Japan

[73] Assignee: Aisin Takaoka Co., Ltd., Toyota, Japan

[21] Appl. No.: 603,220

[22] Filed: Oct. 25, 1990

[30] Foreign Application Priority Data

| | | | |
|---|---|---|---|
| Oct. 30, 1989 | [JP] | Japan | 1-282489 |
| Nov. 10, 1989 | [JP] | Japan | 1-292821 |
| Nov. 10, 1989 | [JP] | Japan | 1-292822 |
| Nov. 10, 1989 | [JP] | Japan | 1-292823 |
| Nov. 10, 1989 | [JP] | Japan | 1-292824 |
| Nov. 10, 1989 | [JP] | Japan | 1-292825 |
| Nov. 10, 1989 | [JP] | Japan | 1-292826 |
| Nov. 10, 1989 | [JP] | Japan | 1-292827 |
| Nov. 10, 1989 | [JP] | Japan | 1-292828 |

[51] Int. Cl.[5] ..... B22D 2/00

[52] U.S. Cl. ..... 164/154; 164/344

[58] Field of Search ..... 164/150, 154, 4.1, 344

[56] References Cited

U.S. PATENT DOCUMENTS 4,359,083 11/1982 Jacobsen ..... 164/344

*Primary Examiner*—Kuang Y. Lin

*Attorney, Agent, or Firm*—Burns, Doane, Swecker & Mathis

[57] ABSTRACT

A flaskless casting line includes a conveyer apparatus for intermittently transferring a flaskless sand mold row, a casting take-out apparatus having a take-out arm, a sand mold top surface sensor for detecting a sprue of sand molds constituting the flaskless sand mold row, a sprue position detecting apparatus, and a take-out arm driving means. Since the sand mold top surface sensor is disposed over an end of the conveyer apparatus on an upstream side with respect to the casting take-out apparatus, the casting take-out apparatus can be guided to an optimum casting take-out position calculated from a sprue position which is detected by the sprue position detecting apparatus. As a result, it is possible to automate the flaskless casting line as well as the following handling operation.

12 Claims, 21 Drawing Sheets

FLASKLESS CASTING LINE

BACKGROUND OF THE INVENTION

1. Field of the Invention

The present invention relates to a flaskless casting line, and more particularly to a flaskless casting line in which a casting take-out operation can be carried out favorably.

2. Description of the Prior Art

In a conventional flaskless casting line, a sand mold molding machine, a molten metal pouring machine, a casting take-out machine and a sand recovery machine are disposed along a conveyor apparatus for transferring sand molds which is operated at intervals. The operation environment cannot be said favorable in view of heat and dust. Hence, it has been desired recently to automate the operation of the conventional flaskless casting line.

As for the casting take-out machine for taking out a casting from a sand mold, it has been known that the various types of the machines are available. For instance, a casting take-out machine which has a drum cooler disposed at an end of a conveyor apparatus has been employed widely in the current casting industry. When sand molds are put into the rotating drum cooler, the sand molds are divided into sand and castings.

Further, a casting take-out machine having a vibrator sieve disposed at an end of a conveyor apparatus has been put into a practical use. In the machine, sand molds are dropped into the vibrator sieve to divide the sand molds into sand and castings.

Moreover, a casting take-out machine is disclosed in Japanese Unexamined Utility Model Publication (KOKAI) Nos. 6146/1988, 163260/1988 and 170066/1988 and Japanese Unexamined Patent Publication (KOKAI) No. 252666/1988. The casting take-out machine is disposed in a manner facing an end of a conveyor apparatus, and has a placement arm to be pierced into a lower portion of a sand mold disposed below a casting and a pressing arm to be pierce into an upper portion of the sand mold disposed above the casting. When taking out the casting form the sand mold, the arms are first pierced into the sand mold, and thereafter they are moved relatively in a direction approaching each other to hold the casting in the vertical direction. Then, the arms are rotated or moved straight in a horizontal plate to take out the casting from the sand mold.

However, in the casting take-out machine having the drum cooler or the vibrator sieve, the castings are taken out in a various attitudes and positions. Accordingly, it has been impossible to automate the handling operation after the casting operation, for instance, an operation for placing the castings onto a casting transferring conveyor apparatus. Hence, the operation should be carried out manually and consequently heavy labors have been imposed on the operators in an inferior environment.

The casting take-out apparatus disclosed in the above-mentioned publications is intended to take out the casting in a predetermined attitude, thereby solving the problems of the casting take-out apparatus having the drum cooler or the vibrator sieve. However, the casting take-out apparatus disclosed in the publications suffers from the following problems:

The first problem is that the stop positions of the sand molds fluctuate as an conveyer apparatus is operated at intervals. Namely, the individual sand molds constituting a flaskless sand mold row are compressed in a transferring direction by an impact force resulting from the activation and deactivation of the conveyor apparatus during the transfer operation. Strictly speaking, the movement distance of the conveyor apparatus is not constant for each of the transfer operation. As a result of these problems, the stop positions of the sand molds fluctuate when the sand molds arrives under the casting take-out apparatus. In the case that the stop positions of the sand molds fluctuate under the casting take-out apparatus, the relative position of the take-out arm and the casting varies in the transferring direction even when the take-out arm is pierced into the sand mold by a predetermined depth, and accordingly the following handling operation is troubled. For instance, in the case that the take-out casting should be placed onto a casting transferring conveyor, it is hard to carry out the placement of the casting when the casting is not held at a predetermined position of the take-out arm, i.e., at a front end thereof in general. Further, there is a possibility that the casting is hooked incompletely onto the take-out arm. If such is the case, the casting take-out operation also results in a failure.

The second problem is that the gap, the slippage and the breakage and the like occur in the boundaries between the individual sand molds constituting the flaskless sand mold row as illustrated in FIG. 5. Consequently, the castings get out of position, thereby causing a failure casting take-out operation and damaging the castings with the take-out arm.

The third problem is that the casting take-out apparatus is arranged so that it holds the casting, especially the product portion thereof, by a large holding force in the vertical direction. Hence, there is a possibility that the take-out arm damages the casting. In the case that the casting surface to be held is not flat in the horizontal direction or that the casting surface to be held has an insufficient area, the possibility becomes more likely to happen. Further, in the case that various kinds of castings should be molded in different sand molds on an identical flaskless casting line, it is extremely hard to hold the castings having a configuration varying each other with the casting take-out apparatus.

SUMMARY OF THE INVENTION

The present invention has been developed in view of the problems associating with the flaskless casting lines of the prior art. It is therefore an object of the present invention and also an engineering assignment thereto to provide a flaskless casting line in which castings can be securely taken out from molds in a predetermined attitude being favorable for the following handling operation, and in which there is no fear for damaging the castings during the casting take-out operation.

The object of the present invention can be carried out by a flaskless casting line comprising: a conveyer means for intermittently transferring a flaskless sand mold row having a plurality of sand molds connected in a row in a transferring direction, the sand molds having a sprue; a casting take-out means having a take-out arm for taking out a casting from the sand molds, the casting take-out means disposed at an end of the conveyor means; a sand mold top surface sensor for detecting conditions of top surfaces of the sand molds, the sand mold top surface sensor disposed over the end of the conveyor means; a sprue position detecting means for processing output signals of the sand mold top surface sensor and detecting a position of the sprue in the transferring direction; and a take-out arm driving means for moving the take-out arm of the casting take-out means to a casting take-out position calculated from the position of the sprue detected.

As for the sand mold top surface sensor, a linear imager may be employed which picks up an image of the top surfaces of the sand molds in the transferring direction while travelling across the sprue, or an area imager may be employed which picks up an image of the top surfaces of the sand molds including the sprue. Further, a photo sensor which picks up an image of a point on the top surfaces of the sand molds may be combined with a mover mean which moves the photo sensor in the transferring direction with respect to the sand molds. Since the imagers and the photo sensor detect the visible rays and the infrared rays, the top surfaces of the sand molds are lighted with a lighting means.

Additionally, as for the sand mold top surface sensor, a radiation thermometer or an infrared sensor which detects a temperature at a point on the top surfaces of the sand molds in a non-contact manner may be combined with a mover means which moves the radiation thermometer or the infrared sensor in the transferring direction with respect to the sand molds. Further, an infrared linear imager may be employed which picks up an image of the top surfaces of the sand molds in the transferring direction while travelling across the sprue, or an infrared area imager may be employed which picks up an image of the top surfaces of the sand molds including the sprue. In the case that the infrared linear imager or the infrared area imager is employed to detect a temperature image of the top surfaces of the sand molds, the lighting on the top surfaces of the sand molds should not be done with infrared rays having a wavelength band identical to that of the temperature image to be detected.

Furthermore, as for the sand mold top surface sensor, a magnetic sensor may be employed. In the case of a ferrous casting, the sprue can be detected from a magnetic flux distribution on the top surfaces of the sand molds. In the case of a non-ferrous casting, the sprue can be detected from an eddy current loss distribution on the top surfaces of the sand molds. In addition, the sand mold top surface sensor may be a photo sensor or color sensor which detects a brightness or a color at a point on the top surfaces of the sand molds.

The sand mold top surface temperature sensor may be employed by one at least. If such is the case, the sand mold top surface temperature sensor detects over a travelling distance equal to a nominal dimension "Lo" of one sand mold in the transferring direction for each operation period of the conveyer means. Since there is a possibility that a sprue may be detected partially for each operation period of the conveyer means when one sand mold top surface sensor is employed, it is preferred to combine and process data detected in the operation period thereof immediately before together with data over a distance of "2×Lo" in the transferring direction, thereby obtaining data including the sprue and calculating the position of the sprue therefrom.

In the case that two sand mold top surface temperature sensors are disposed at positions away from each other by a distance of one transferring distance or less on a line extending in the transferring direction, a similar effect can be obtained when data detected by both of the sensors for one operation period of the conveyor means are combined and processed.

Moreover, the flaskless casting line according to the present invention may further include a conveyor travelling distance detecting means. As for the conveyor travelling distance detecting means, a rotary encoder may be employed which detects the rotation of a roller of the conveyer means, or another means may be employed which detects a pattern provided regularly on the conveyer means.

The flaskless casting line according to the present invention operates as follows. The conveyer means transfers the flaskless sand mold row intermittently. The flaskless sand mold row has a plurality of sand molds connected in a row in the transferring direction, and the sand molds have a sprue disposed regularly, namely at predetermined intervals, on the top surfaces thereof. The sand mold top surface sensor detects the conditions of the sand mold top surfaces including the sprue. The sprue position detecting means processes the output signals of the sand mold top surface sensor to detect the position of the sprue in the transferring direction. Since the position of the sprue and the take-out position of the casting has been set in a predetermined relationship in advance, the take-out position of the casting in the transferring direction can be presumed precisely in accordance with the detection of the position of the sprue in the transferring direction. As a result, the take-out arm driving means controls the take-out arm of the casting take-out means in accordance with the information on the take-out position of the casting thus obtained, and the take-out arm can take out the casting without failure regardless of the variation or fluctuation in the take-out position of the casting.

The flaskless casting line according to the present invention operates similarly in the case that it employs the sand mold top surface temperature measuring means as an alternative for the sand mold top surface sensor. As aforementioned, the sand mold top surface temperature measuring means detected infrared rays radiated from the sand mold top surfaces as well as the sprue.

As described so far, the flaskless casting line according to the present invention has the sand mold top surface sensor which is disposed at the end of the conveyor means on an upstream side with respect to the casting take-out means in the transferring direction, detects the position of the sprue of the sand molds, detects the casting take-out position from the position of the sprue detected, and takes out the casting after positioning the casting take-out means at the casting take-out position. Hence, the flaskless casting line effects the following advantages:

(1) The casting take-out position can be presumed precisely.

(2) A gate portion formed integrally with the casting can be held with the casting take-out means, thereby avoiding damages to the casting.

(3) The casting can be taken out not only in the transferring direction horizontally but also in the right and left directions with respect to the conveyor means or even in the upward direction.

(4) Failure detections of the sprue positions can be reduced sharply.

Thus, the flaskless casting line according to the present invention solves the problems of the prior art flaskless casting lines, and enables to automate the following handling operation.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS OF THE INVENTION

Having generally described the present invention, a further understanding can be obtained by reference to certain specific preferred embodiments which are provided herein for purposes of illustration only and are not intended to be limiting unless otherwise specified.

First Preferred Embodiment

Figure 1:
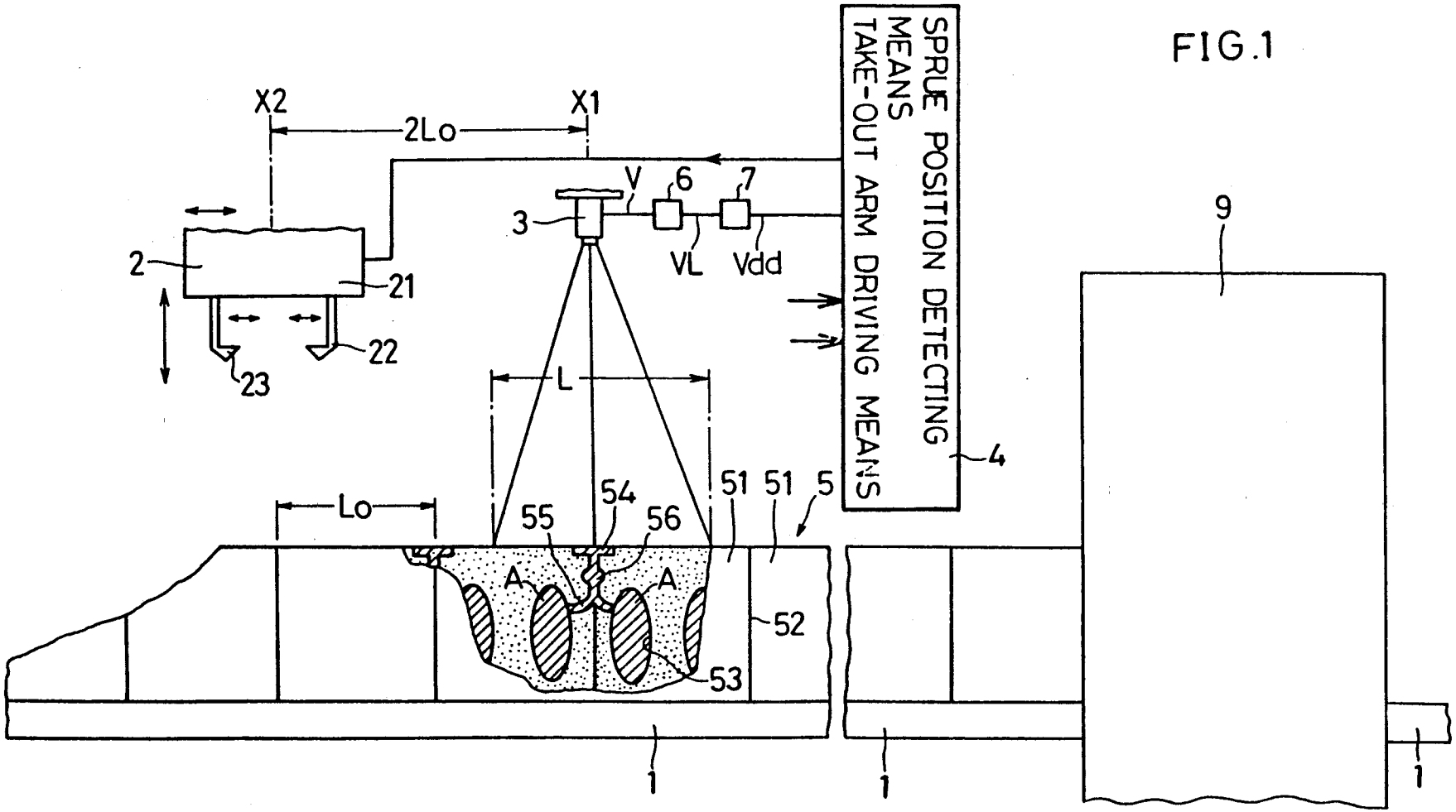
FIG. 1 is a block diagram illustrating a sequence of a casting take-out operation carried out by a flaskless casting line of a first preferred embodiment according to the present invention.

A flaskless casting line of a first preferred embodiment according to the present invention will be hereinafter described with reference to FIGS. 1 through 13. As illustrated in FIG. 1, the flaskless casting line includes a conveyer apparatus (a conveyer means) 1, a flaskless sand mold molding apparatus (a flaskless sand mold molding means) 9, a low-pass filter 6, an A/D converter 7, a casting take-out apparatus (a casting take-out means) 2, a sand mold top surface temperature measuring apparatus (a sand mold top surface temperature measuring means) 3, and a microcomputer apparatus (a microcomputer means) 4 working both as a sprue position detecting means and a take-out arm driving means.

Figure 7:
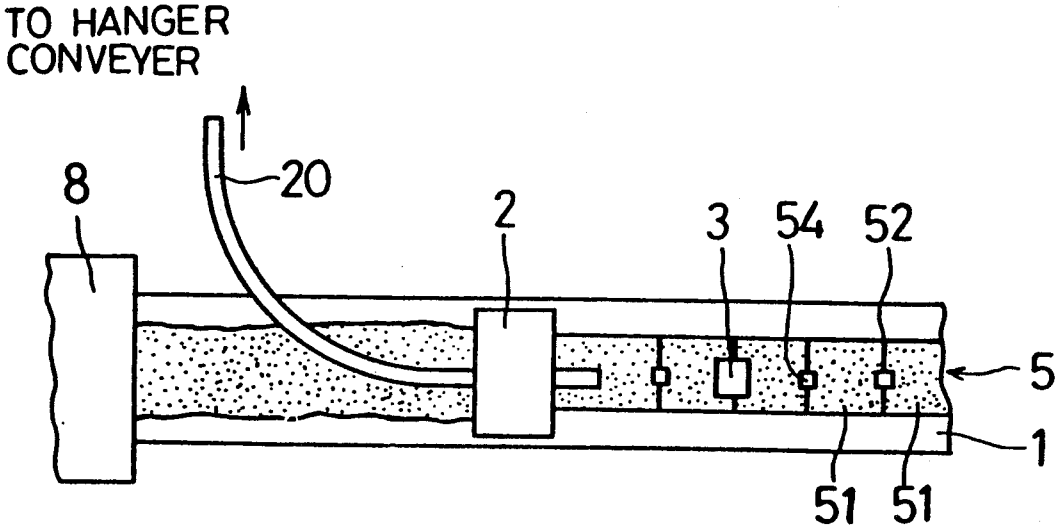
FIG. 7 is a plan view of an end of a conveyer apparatus 1 of the flaskless casting line of the first preferred embodiment.
Figure 8:
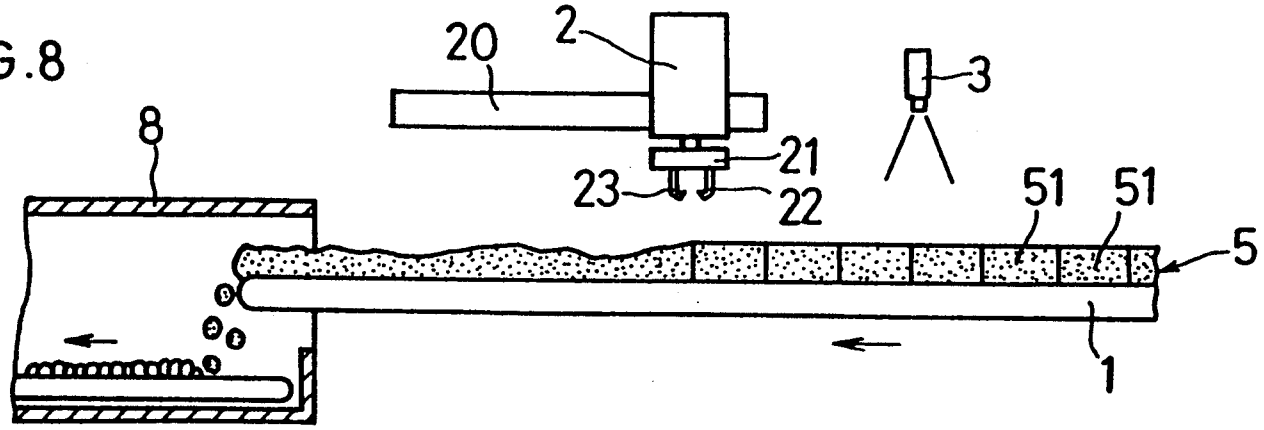
FIG. 8 is a side view of the end of the conveyer apparatus 1 of the flaskless casting line of the first preferred embodiment.

The conveyer apparatus 1 includes an ordinary belt conveyer, and an end thereof is illustrated in FIGS. 1, 7 and 8. The conveyer apparatus 1 is operated intermittently, namely it is operated for 2.2 seconds and put into a standby state for 12.8 seconds. During the standby period, a sprue center position is detected and a casting take-out operation is carried out. The conveyer apparatus 1 advances a flaskless sand mold row 5 by a distance which is equal to a normal dimension "Lo" of a sand mold 51 in a transferring direction.

The flaskless sand mold molding apparatus 9 and a molten metal pouring apparatus (not shown) are disposed on upstream sides with respect to the conveyer apparatus 1. Further, the casting take-out apparatus 2 and the sand mold top surface temperature measuring apparatus 3 are disposed at an end of the conveyor apparatus 1 away from the molten metal pouring apparatus by approximately 50 m, thereby cooling the molten metal. Moreover, as illustrated in FIG. 8, a sand recovery apparatus 8 having a built-in sand recovery conveyer is disposed at a terminating end of the conveyer apparatus 1.

As illustrated in FIG. 1, the flaskless sand mold row 5 including approximately 200 pieces of the sand molds 51 connected in a row is placed on the conveyer apparatus 1. A cavity 53 for a casting product is formed on a boundary 52 between the neighboring two sand molds 51. A sprue 54 is disposed across the top surfaces of the sand molds 51 on the boundary 52, the sprue 54 which has a substantially square shape and is communicated to the cavities 53. Further, a gate 56 is formed at a position in-between the cavities 53 and the sprue 54 in a manner extending horizontally in a direction perpendicular to the transferring direction. The molten metal poured through the sprue 54 is cooled and solidified into four pieces of castings "A," i.e., product portions, made of cast iron and other castings disposed in the sprue 54, a runner 55 and the gate 56. Hereinafter, the sprue 54, the runner 55 and the gate 56 shall mean the castings formed therein. The nominal dimension "Lo" of the sand molds 51 in the transferring direction and one side of the sprue 54 are formed respectively in approximately 28 cm and 8 cm in advance. Here, the gate 56 constitutes a portion of the casting to be held by the casting take-out apparatus 2.

The flaskless sand mold molding apparatus 9 is disposed at a beginning end of the conveyer apparatus 1. The flaskless sand mold molding apparatus 9 molds one of the sand molds 51 on the conveyer apparatus 1 during the standby period of the conveyer apparatus 1, and thereafter pushes the sand molds 51 thus molded onto an end of the flaskless sand mold row 5 one by one. Since the flaskless sand mold molding apparatus 9 has been well known, it will not be described in detail. However, an important point is that the configuration of the gating system including the sprue 54, the runner 55 and the gate 56 is always invariable regardless of the fast that the configuration of the cavities 53 are varied.

Figure 6:
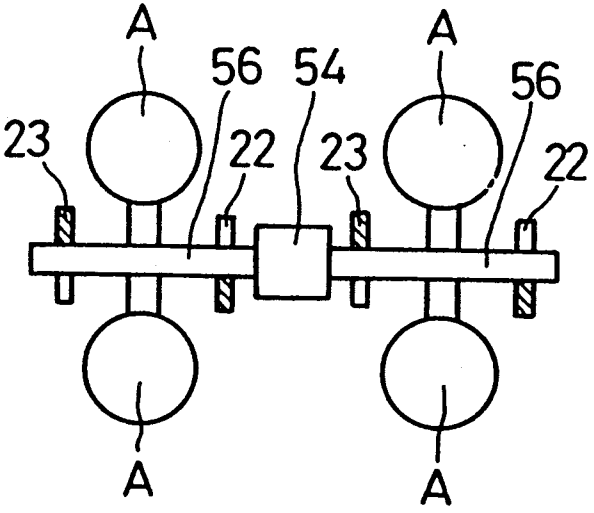
FIG. 6 is a plan view of a casting "A" shown in FIG. 1.
Figure 5:
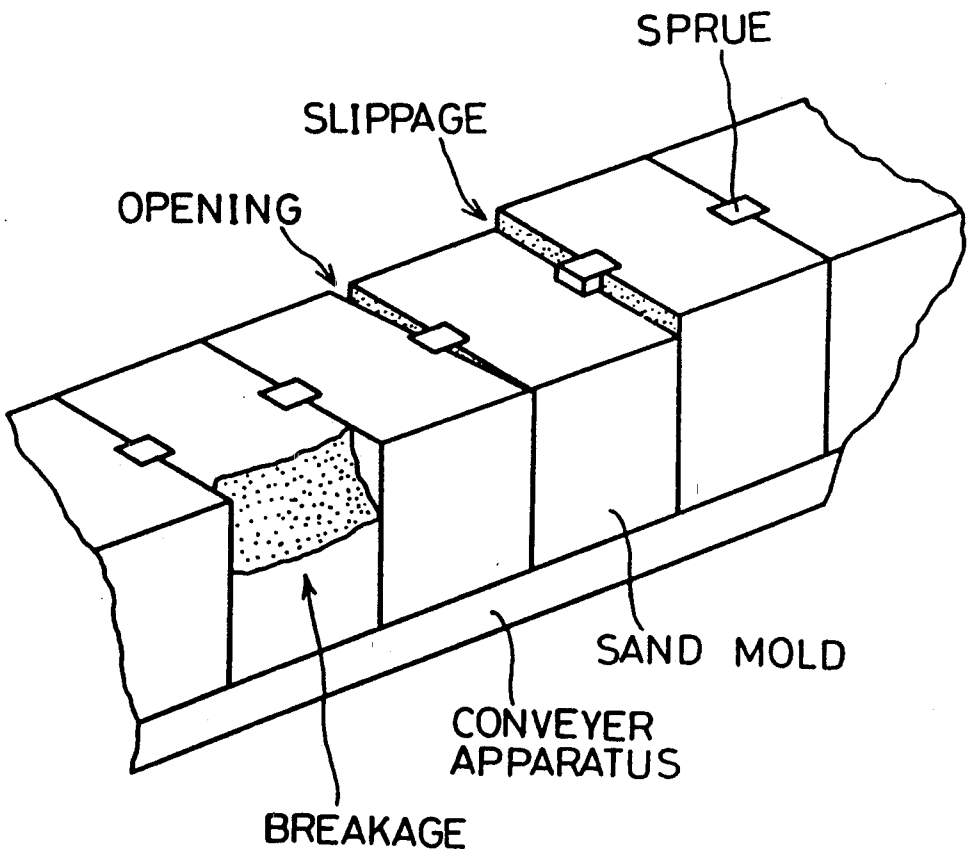
FIG. 5 is a schematic perspective view illustrating examples of abnormal sand molds in a flaskless sand mold row.

As illustrated in FIGS. 7 and 8, the casting take-out apparatus 2 is held movably on a rail 20 which is disposed over the end of the conveyer apparatus 1, and travels on the rail 20. An end of the rail 20 is extended over the conveyor apparatus 1, and disposed over a central portion of the conveyer apparatus 1 in the right and left directions of the conveyer apparatus 1. Further, the rail 20 is bent at the central portion thereof upward in FIG. 7, and the other end of the rail 20 is disposed perpendicularly to the transferring direction and adjacent to a hanger conveyer (not shown). On a bottom surface of the casting take-out apparatus 2, two pairs of take-out arms 22 and 23 are protruded downward. The take-out arms 22 and 23 are disposed in a manner facing each other in the extending direction of the rail 20, and the relative distance between the take-out arms 22 and 23 are made variable by an hydraulic cylinder (not shown) incorporated in the casting take-out apparatus 2. Furthermore, as illustrated in FIG. 6, the take-out arms 22 and 23 are disposed alternately, and a protrusion for placing the gate 56 of the casting thereon is formed at the ends of the take-out arms 22 and 23. Here, a current position of the casting take-out apparatus 2 is always detected with an encoder (not shown), and input into the micorcomputer apparatus 4. The casting take-out apparatus 2 gives the casting taken-out in a predetermined attitude to a robot (not shown), and the robot hooks the casting onto the hanger conveyer (not shown). After giving the casting to the robot, the casting take-out apparatus 2 returns automatically to a datum position "x2," and thereafter moves to an optimum casting take-out position while guided by the microcomputer apparatus 4.

The sand mold top surface temperature measuring apparatus 3 includes a radiation thermometer portion disposed at an end of the conveyer apparatus 1 and a mover apparatus portion which moves the radiation thermometer portion to and fro by once for each of the standby period of the conveyer apparatus 1. The sand mold top surface temperature measuring apparatus 3 is placed downward over a central portion of the conveyer apparatus 1 in the right and left directions of the conveyer apparatus 1, thereby detecting the infrared rays radiated from the sand mold top surfaces of the flaskless sand mold row 5. Further, the mover apparatus is provided with a rotary encoder (not shown) which outputs a current position of the radiation thermometer portion in the transferring direction. Namely, while the sand mold top surface measuring apparatus 3 is travelling, it outputs a temperature of the sand mold 51 which is placed directly under it as well as its current position in the transferring direction to the microcomputer apparatus 4. The sand mold top surface temperature measuring apparatus 3 is disposed at a sensor datum position "x1" which is placed away from the datum position "x2" of the casting take-out apparatus 2 by a distance being equal to "2Lo," i.e., twice the nominal dimension "Lo" of one sand mold 51 in the transferring direction, on the upstream side in the transferring direction. The sand mold top surface temperature measuring apparatus 3 moves by "0.75Lo" in both the upstream and downstream directions with respect to the sensor datum position "x1" for each of the measuring operation. It is so arranged because the detecting operation of a sprue center position "m" and the casting take-out operation are carried out simultaneously during the standby period of the conveyer apparatus 1. Hence, let a distance from the sensor datum position "x1" to a sprue center position "m" be $\Delta x$, it is necessary to move the casting take-out apparatus 2 only by $\Delta x$ in the casting take-out operation after the next. In this case, a positional displacement of a sand mold 51 is neglected which has occurred while the sand mold 51 moves from a position under the sand mold top surface temperature measuring approximately 3 to a position under the casting take-out apparatus 2.

As aforementioned, a dimension "L" over which the image can be picked up in the transferring direction is set larger than the nominal dimension "Lo" of one sand mold 51 in the transferring direction, and it is accordingly possible to completely pick up the image of at least one sand mold 51. Further, according to an actual measurement, a temperature of the top surface of the sand mold 51 was 200° C. or less and a temperature of the sprue 54 was approximately 500° C. Hence, an infrared filter is employed in order to set a sensible wavelength band of the radiation thermometer portion in a range between 0.8 to 3 micrometers and more preferably in a range between 1 to 2 micrometers. These wavelength bands are favorable for identifying the sand and the sprue because the infrared energy radiated from the sand is extremely small in these wavelength bands.

For reference, the results of the actual measurement are set forth below:

At a sprue center position "m": 391° to 567° C., 494° C. in average

At a sand surface adjacent to a sprue 54: 78° to 173° C., 130° C., in average At a sand surface between sprues 54: 77° to 149° C., 114° C. in average The fluctuations of the temperatures are believed to result from the time elapsing after the start-up of a pilot line, the variation in the weather and speeds of the pilot line.

The low-pass filter 6 shuts off high band components of the output signal voltage, i.e., the sand mold top surface temperature signal "V," and transmits only low band components thereof "VL" to the A/D converter. The high band components contain a plenty of noise voltages resulting from infrared radiation intensity fluctuations due to roughened sand surfaces infrared absorption fluctuations due to water vapor generated from the sand molds 51, and sprues 54 covered with sand. Accordingly, the shut-off frequencies of the low-pass filter 6 are set at values so that the high band noise components resulting from these causes are shut off.

The A/D converter 7 carries out A/D conversion to the low band components "VL." The low band components "VL" are thus converted into a digital sand mold top surface temperature signal "Vdd," and input into the microcomputer apparatus 4.

Figure 2:
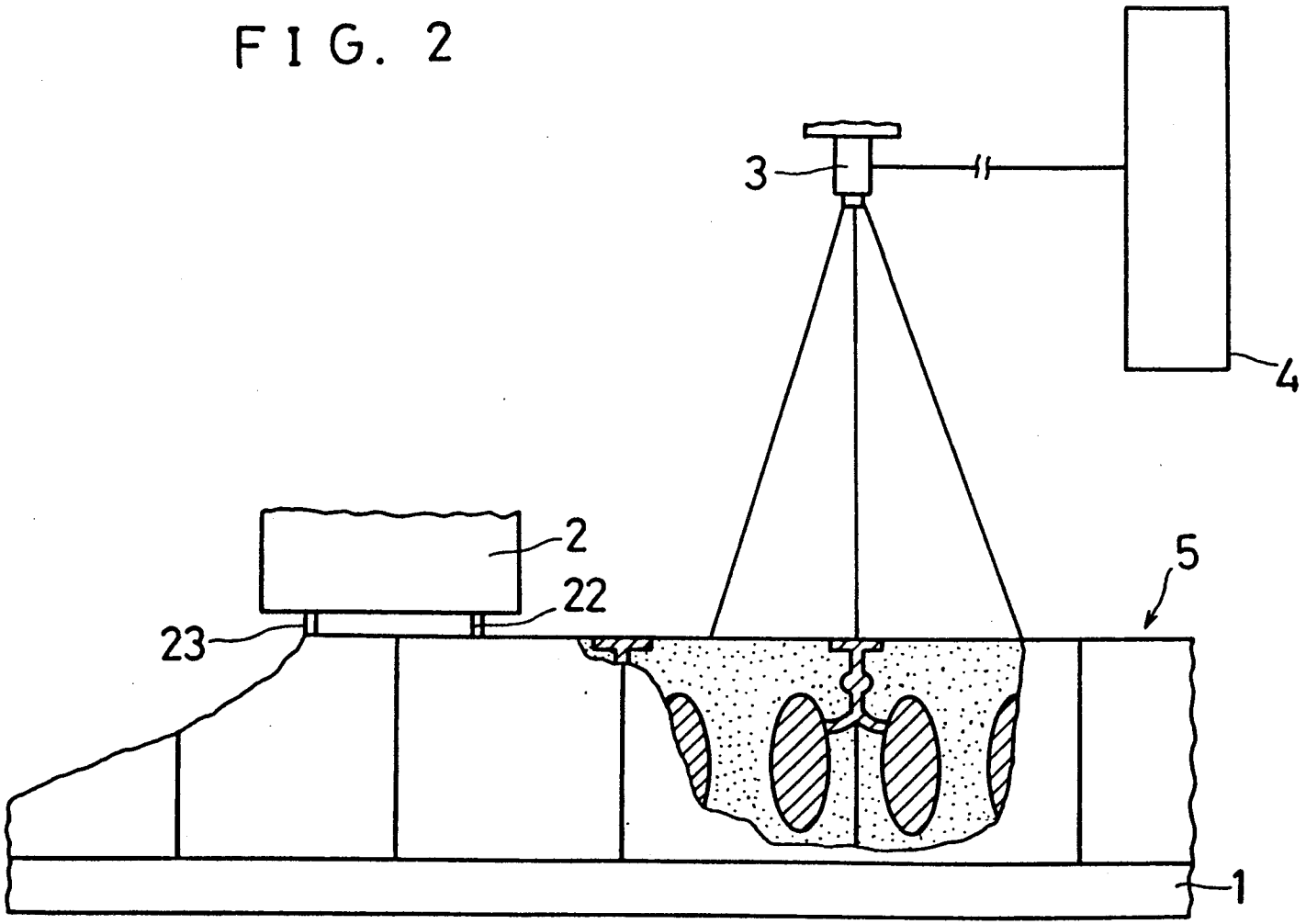
FIG. 2 is a block diagram illustrating another sequence of the casting take-out operation carried out by the flaskless casting line of the first preferred embodiment.
Figure 3:
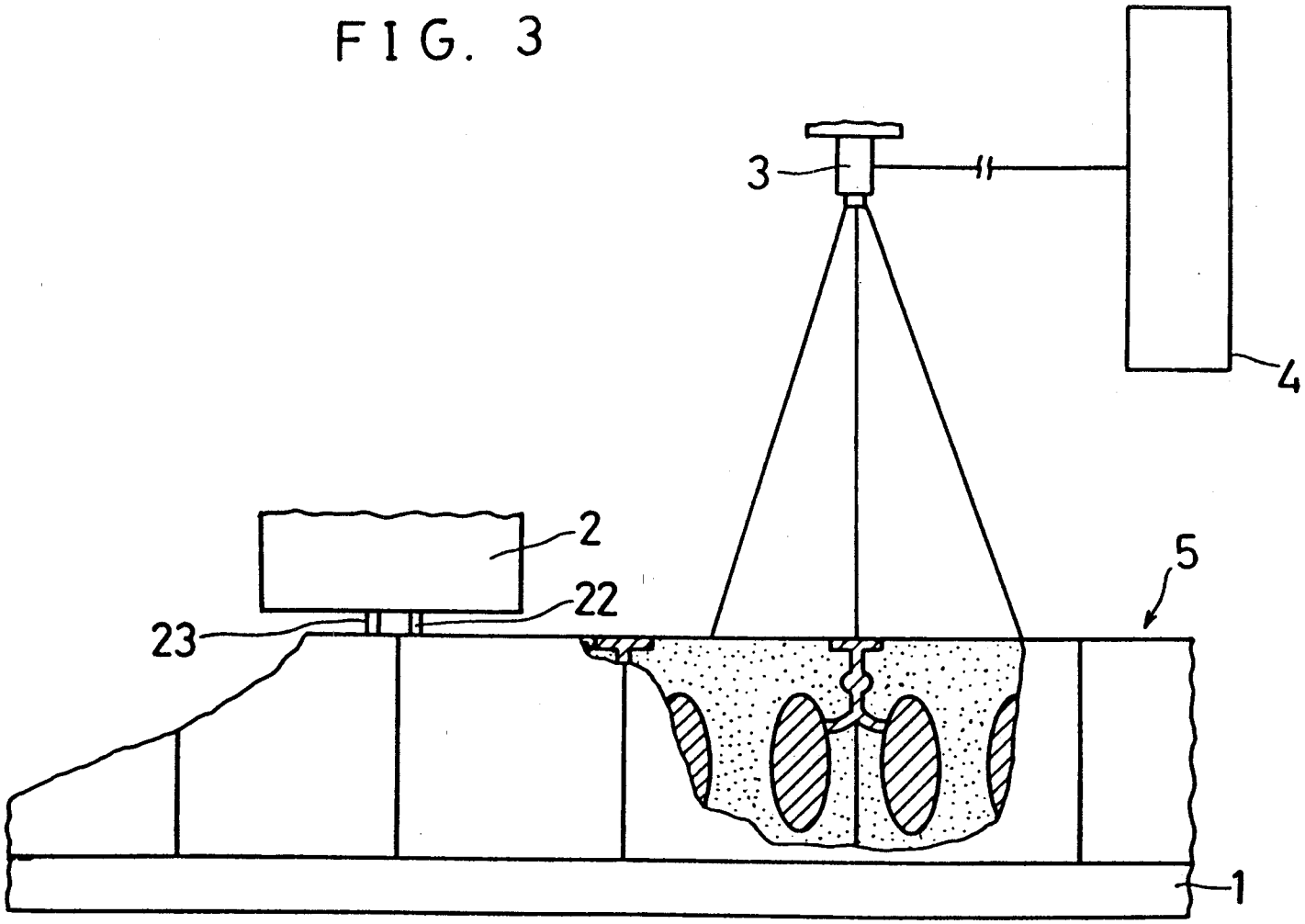
FIG. 3 is a block diagram illustrating still another sequence of the casting take-out operation carried out by the flaskless casting line of the first preferred embodiment.
Figure 4:
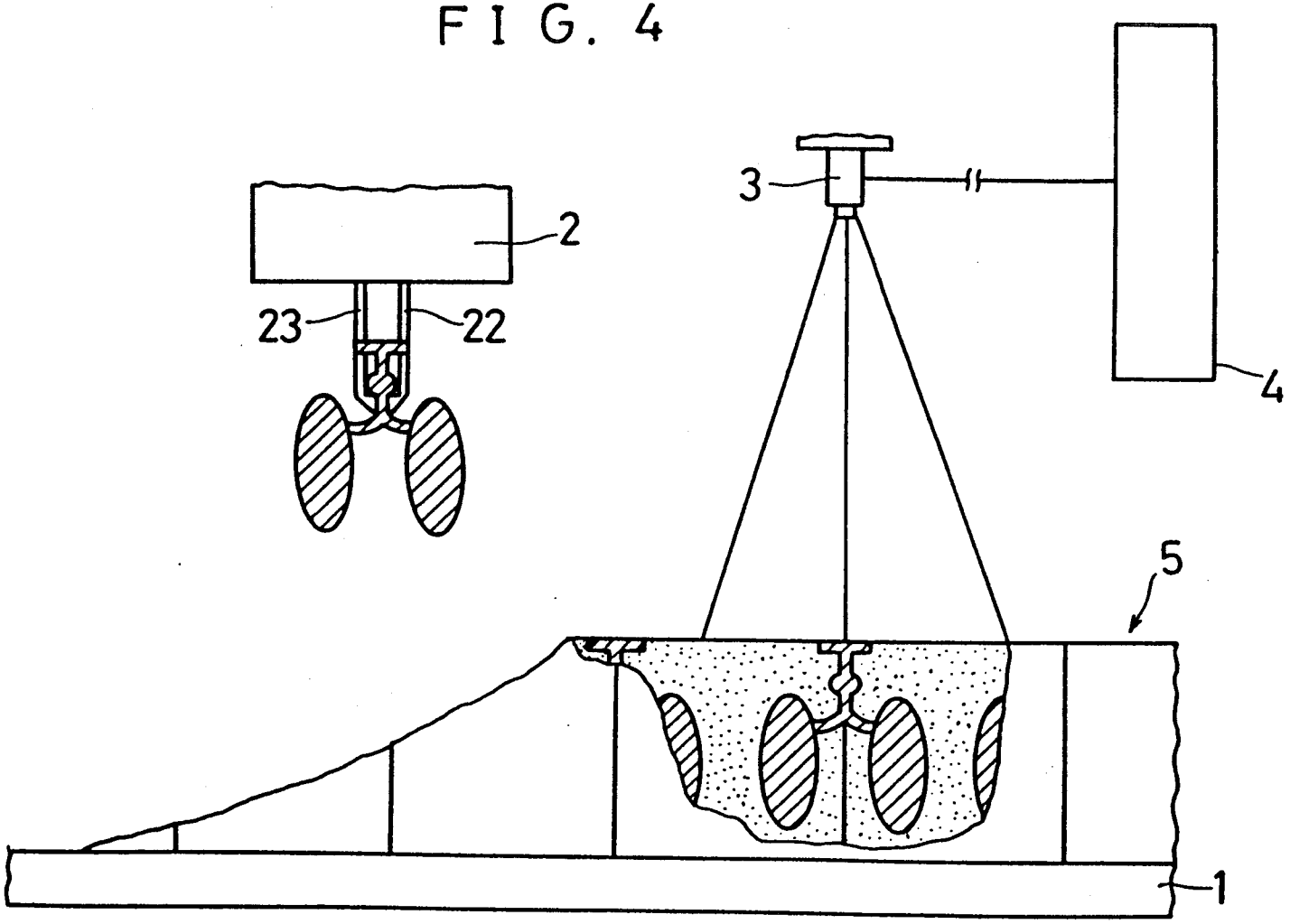
FIG. 4 is a block diagram illustrating a further sequence of the casting take-out operation carried out by the flaskless casting line of the first preferred embodiment.

The microcomputer apparatus 4 has the following functions: processing the digital sand mold top surface temperature signal "Vdd" to calculate a sprue center position "m," calculating a position of a gate 56 of a casting (i.e., a take-out position) from the calculated sprue center position "m," moving the casting take-out apparatus 2 in the transferring direction to a position over the calculated take-out position. Further, as illustrated in FIG. 2, the microcomputer apparatus 4 has the casting take-out apparatus 2 descend to precise the two pairs of the take-out arms 22 and 23 into the sand mold 51 in a manner holding the gate 56 on the both surfaces in the transferring direction. Then, as illustrated in FIG. 3, the microcomputer apparatus 4 has the take-out arms 22 and 23 move in the direction approaching each other. Further, as illustrated in FIG. 4, the microcomputer apparatus 4 has the casting take-out apparatus 2 move along the rail 20 after lifting the casting take-out apparatus 2. Finally, the robot (not shown) receives the taken-out casting from the casting take-out apparatus 2, and then hooks the casting onto the conveyer hanger (not shown).

The operation of the microcomputer apparatus 4 will be hereinafter described in detail with reference to the sand mold top surface temperature distribution diagram illustrated in FIG. 9, the signal waveforms illustrated in FIG. 10 and the flow charts illustrated in FIGS. 11 through 13.

Figure 11:
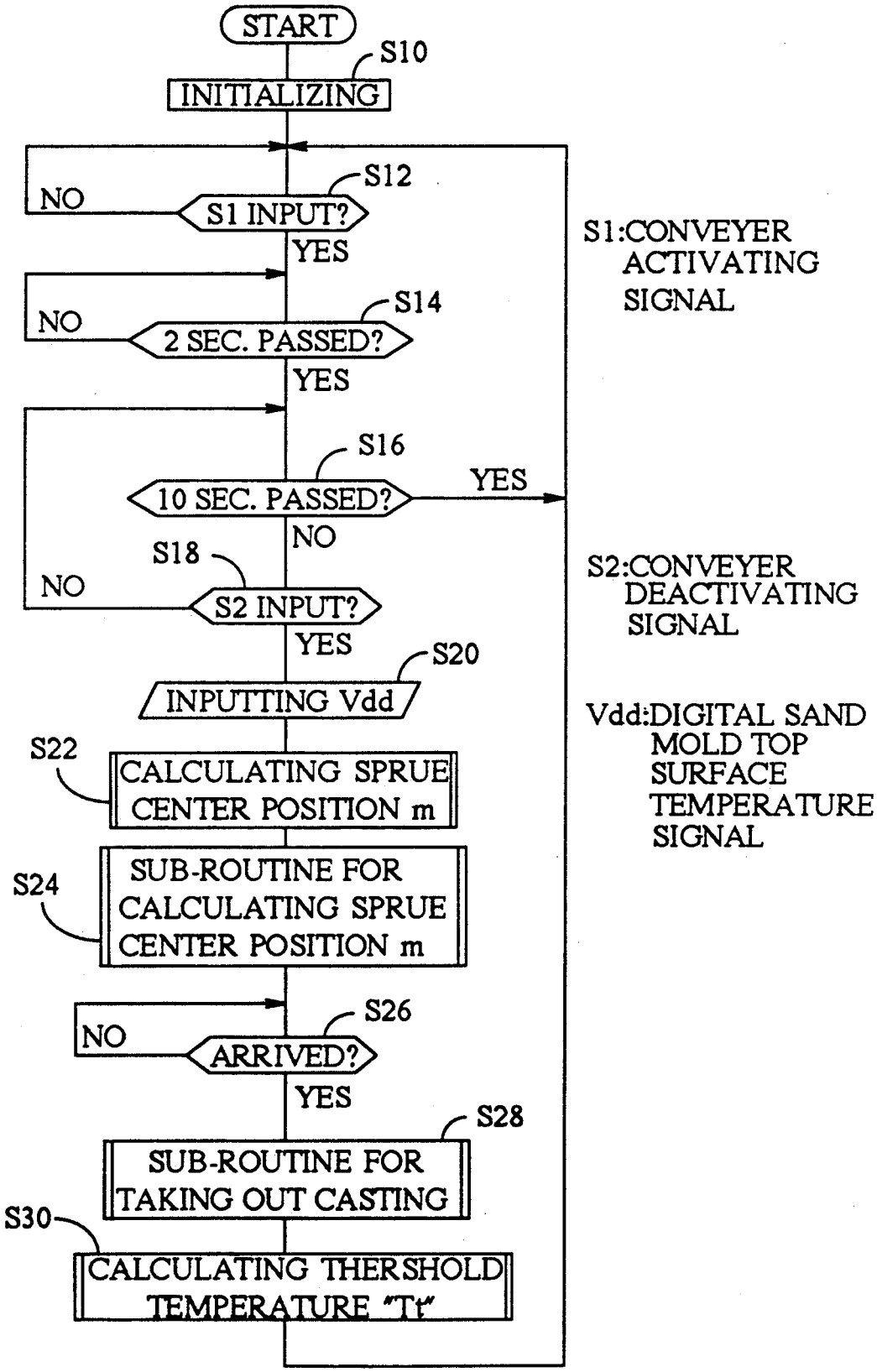
FIG. 11 is a flow chart illustrating an operation sequence of the microcomputer apparatus 4 of the flaskless casting line of the first preferred embodiment.

As illustrated in the flow chart of FIG. 11, the microcomputer apparatus 4 is initialized at step "S10," and put into a standby state until a conveyer activating signal "S1" is input at step "S12." Here, the conveyer activating signal "S1" and a conveyer deactivating signal "S2" are input into the microcomputer apparatus 4 by a central processing apparatus (not shown) which controls the conveyer apparatus 1. After the conveyer activating signal "S1" is input, the microcomputer apparatus 4 checks whether 2 seconds have passed thereafter at step "S14." Then, the microcomputer apparatus 4 checks whether 10 seconds have passed at step "S16" and whether the conveyer deactivating signal "S2" is input before 10 seconds have passed at step "S18." If such is the case, the microcomputer apparatus 4 proceeds to step "S20." If the microcomputer apparatus 4 judges that 10 seconds have passed and the conveyer deactivating signal "S2" has not input, it judges the conveyer activating signal "S1" input at step "S12" was an abnormal signal and returns to step "S12." By carrying out the steps "S12" through "S16," it is possible to prevent the casting take-out apparatus 2 from being activated by abnormal signals other than the conveyer activating signal "S1" output during the predetermined operation at normal intervals.

When the conveyer deactivating signal "S2" is input at step "S18," the microcomputer apparatus 4 receives the digital sand mold top surface temperature signal "Vdd" from the sand mold top surface temperature measuring apparatus 3 by way of the low-pass filter 6 and the A/D converter 7 at step "S20." The microcomputer apparatus 4 processes the received digital sand mold top surface temperature signal "Vdd" to calculate a central position of the sprue 54 in the transferring direction, namely the sprue center position "m," as well as coordinate positions "L1" and "L2" of the sprue center positions "m" (See FIG. 10.) in the transferring direction at step "S22." Here, the coordinate positions "L1" and "L2" in the transferring direction specify distances from the sensor datum position "x1."

A sub-routine program is carried out as follows in order to calculate the above-mentioned sprue center position "m" and the like. Namely, the input digital sand mold top surface temperature signal "Vdd" is digitized into a digitized signal "Vd" with a predetermined threshold voltage "Vt." Then, as illustrated in FIG. 10, the microcomputer apparatus 4 determines an intermediate point between a leading edge and a trailing edge of a high temperature band "Sm" as the sprue center position "m." Here, the high temperature band "Sm" corresponds to a level "1" area of the digitized signal "Vd," and the threshold voltage "Vt" corresponds to the threshold temperature "Tt," i.e., 300° C. in this first preferred embodiment. Further, as illustrated in FIG. 1, two sprue center positions "m" are detected for each of the image pick-up operation. However, when the sprue center position "m" is placed adjacent to the sensor datum position "x1," or a central position of the image pick-up area, one sprue center position "m" is detected for each of the image pick-up operations. In the former case, namely when two sprue center positions "m" are detected for each of the image pick-up operations, one of the sprue center positions "m" disposed on a downstream side in the transferring direction is regarded as the sprue center position "m" to be detected in the current detection operation. If an end of the high temperature band "Sm" (See FIG. 10) overlaps one of the ends of the image pick-up area, the sprue center position "m" of the high temperature band "Sm" cannot be detected precisely. Accordingly, the sprue center position "m" of the other high temperature band "Sm," or the sprue area, disposed on an upstream side in the transferring direction is calculated if such is the case.

Then, at step "S24," the microcomputer apparatus 4 moves the casting take-out apparatus 2 by a distance ("L2"−"x1"), i.e., a difference between the coordinate position "L2" in the transferring direction calculated in the processing operation before the last and the sensor datum position "x1." The casting take-out apparatus 2 is moved in this manner because it is positioned on a downstream side by two pieces of the sand molds 51. When the microcomputer apparatus 4 judges that the casting take-out apparatus 2 arrives at the target position at step "S26," the microcomputer apparatus 4 has the casting take-out apparatus 2 carry out the above-mentioned casting take-out operation at step "S28."

Figure 12:
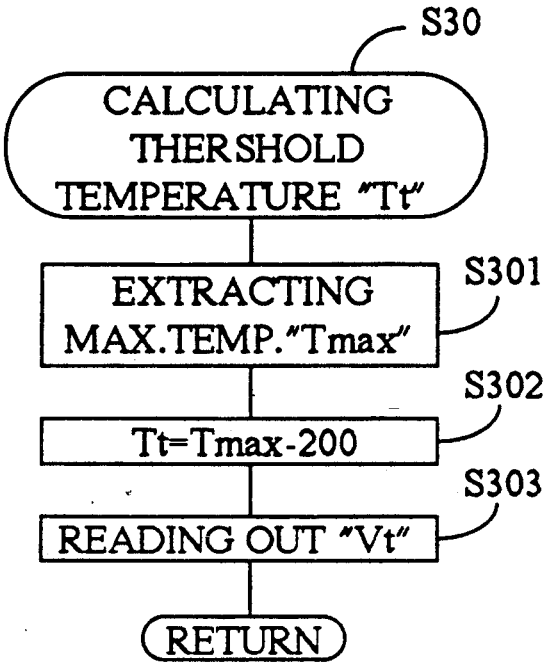
FIG. 12 is a flow chart illustrating another operation sequence of the microcomputer apparatus 4 of the flaskless casting line of the first preferred embodiment.

After the casting take-out operation, the microcomputer apparatus 4 proceeds to step S30 to carry out a threshold temperature calculation sub-routine program illustrated in FIG. 12. In this sub-routine program, a maximum threshold "Tmax" is extracted from the digital sand mold top surface temperature "Vdd" input for the present time at step "S301," a temperature being lower than the maximum temperature "Tmax" by 200° C. is then set as a new threshold temperature "Tt" at step "S302," and finally a threshold voltage "Vt" corresponding to the new threshold temperature "Tt" is generated at step "S303."

Figure 13:
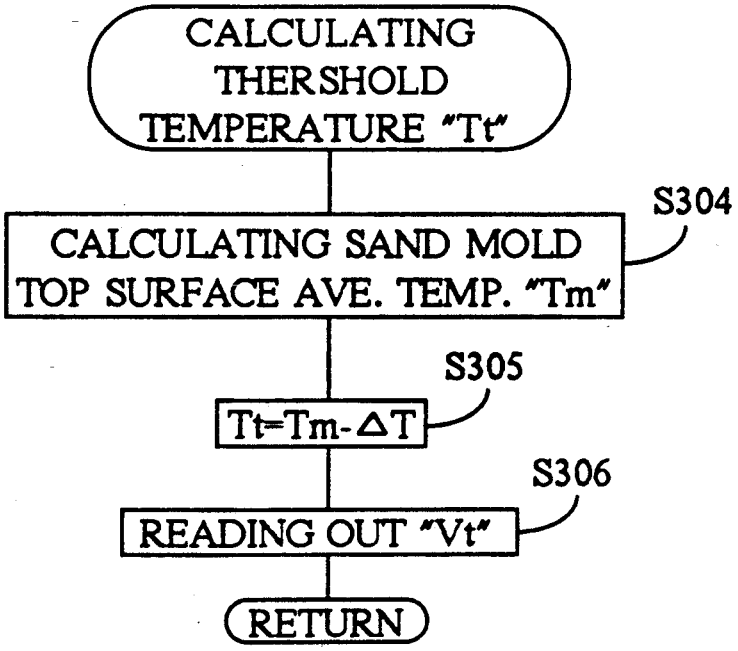
FIG. 13 is a flow chart illustrating still another operation sequence of the microcomputer apparatus 4 of the flaskless casting line of the first preferred embodiment.

An alternative for the threshold temperature calculation sub-routing program, a sub-routine program illustrated in FIG. 13 may be employed. In the sub-routine program, an average temperature "Tm" of one or more sand molds 51 (including the sprue 54) whose temperatures have been detected immediately before may be calculated at step "S304" instead of extracting the maximum temperature "Tmax" of the sand mold 51 (especially the sprue center position "m") for the previous time. A threshold temperature "Tt" may be set at step "S305" so that a predetermined temperature difference "ΔT" is taken away from the average temperature "Tm," and then a threshold voltage "Vt" corresponding to the threshold temperature "Tt" may be generated at step "S306." Accordingly, even when one of the sand molds 51 showed a decreased maximum temperature because of a sand-covered sprue 54 and the like, such an adverse effect can be suppressed by carrying out the sub-routine program. Moreover, as for an another alternative, room temperature may be measured, and the measured room temperature and the threshold temperature "Tt" may be correlated.

As having been described so far, the flaskless casting line of this first preferred embodiment employs the sprue position detecting means which judges the center position of a sprue area corresponding to the high temperature band "Sm" exceeding the predetermined threshold temperature "Tt" set in advance as the sprue center position "m." Hence, the determination of the sprue position can be done more easily and precisely than a sprue position determination method in which an front end and a rear end of the sprue 54 are judged as sprue position.

Since the flaskless casting line of the first preferred embodiment has the sand mold top surface image measuring apparatus 3 disposed at the end of the conveyer apparatus 1 and on an upstream side with respect to the casting take-out apparatus 2 in order to detect the positions of the individual sprues 54, and since it takes out the castings after determining the casting take-out positions from the positions of the sprues 54 and positioning the casting take-out apparatus 2 at the casting take-out positions, it can effect the following advantages.

(1) The casting take-out positions can be presumed precisely, and consequently it is possible to securely take out the castings regardless of the variations and fluctuations on the positions of the castings in the transferring direction. Further, the taken-out castings can always take a predetermined attitude, and the portions of the castings to be taken out can be held with or placed on a predetermined portion of the take-out arms 22 and 23. Hence, the following handling operations are made easier, and can be automated without difficulty. Furthermore, since the casting take-out positions are determined from the positions of the sprues 54 made integral with the castings "A" in the first preferred embodiment, the casting take-out positions not viewable can be determined securely.

(2) Since the casting take-out apparatus 2 can be precisely guided to the portions of the castings to be taken out and it can hold the gates 56 made integrally with the sprues 54, there is no need to hold the product portions "A" of the castings in the vertical direction as they are held in the prior art and there is no fear for damaging them. Further, when the configurations of the product portions "A" of the castings have been changed, there is no need to change the manner of the above-mentioned casting take-out operation.

(3) The casting take-out apparatus 2 can take out the castings not only to the side of the conveyer apparatus 1 in the transferring direction horizontally, as done by a conventional casting take-out apparatus disposed at an end of a conveyor apparatus, but also to the right, left and upper sides thereof. This advantage has been made possible because the positions of the castings in the transferring direction which are likely to fluctuate have been determined precisely. Especially, in the case that the casting take-out apparatus 2 is not disposed at an end of the conveyer apparatus 1, the sand recovery apparatus 8 can be connected directly to and disposed at a terminating end of the conveyor apparatus 1. Accordingly, it is easy to lay out the sand recovery apparatus 8.

Further, in the case that the casting take-out apparatus 2 is disposed at an end of the conveyor apparatus 1 and the castings are taken out in the transferring direction horizontally as done in a conventional flaskless casting line, it is possible to appropriately adjust the piercing distance of the take-out arms 22 and 23 and avoid the failure casting take-out operations resulting from insufficient or excessive piercing of the take-out arms 22 and 23 because the casting take-out positions are found precisely by the flaskless casting line of the first preferred embodiment.

Furthermore, when picking up a one-dimensional image of the sand mold top surface or the sand mold top surface temperature in the transferring direction, the amount of information to be processed and the arrangement of flaskless casting line can be simplified and the processing speed can be increased sharply because the fluctuations of the sand mold positioning depend on the activation and deactivation of the conveyer apparatus 1 and occur especially in the transferring direction.

Moreover, since the flaskless casting line of the first preferred embodiment detects the sand mold top surface temperature distribution and determines the casting take-out positions, it has the following additional advantages:

(4) In the case that the sprue 54 is covered with the sand and the configuration of the sprue 54 becomes abnormal, a small amount of the sand covering the sprue 54 is heated by the high temperature casting formed in the sprue 54 and a temperature thereof is made higher than the other portions. Hence, the flaskless casting line of the first preferred embodiment suffers less from failure detections of abnormal sprue configurations than a conventional optical detection method. Additionally, the running of the molten metal may occur around the sprue 54 and the configuration of the sprue 54 may become abnormal. If such is the case, however, a small amount of the molten metal running over the sand around the sprue 54 is cooled by the sand of lower temperatures and a temperature of the running molten metal becomes cooler than the casting formed in the sprue 54. Consequently, the flaskless casting line of the first preferred embodiment suffers less from failure detections of abnormal sprue configurations than a conventional optical detection method.

Since the flaskless casting line of the first preferred embodiment have the casting take-out apparatus 2 take out the castings upward, it further effects the following additional advantages.

(5) Since the castings are taken out upward, the scattering of the sand can be made less than it occurred in the conventional take-out operation in which the castings are taken out sideward. Thus, the environment surrounding the flaskless casting line can be cleaned.

(6) The sand recovery apparatus 8 can be disposed at a terminating end of the conveyer apparatus 1 without being obstructed by the casting take-out apparatus 2. Accordingly, it is easy to lay out the sand recovery apparatus 8.

(7) A plurality of the casting take-out apparatuses 2 can be disposed in series at ends of the conveyor apparatus 1 along the transferring direction thereof. Or a single casting take-out apparatus 2 can simultaneously take out a plurality of the castings neighboring each other. As a result, the time required for taking out a casting can be shortened, and the standby period of the conveyer apparatus 1 can be shortened accordingly.

(8) The casting take-out apparatus 2 can hold and place the sprue 54 disposed on the top of the sand mold 51 or the runner 55 and the gate 56 disposed between the sprue 54 and the product portion "A," the piercing distance of the take-out arms 22 and 23 can be set less than that of a conventional casting take-out apparatus which pierces its take-out arms sideward into a sand mold and holds a product portion of a casting, and the take-out arms 22 and 23 will not damage a surface of the product portion "A." In addition, when the configurations of the product portions "A" are changed, the casting take-out apparatus 2 can take out the castings with ease.

Here, the upward casting take-out operation effecting the advantage closely relates to the detection of the casting take-out position. Namely, in the case that a conveyor apparatus is operated intermittently by a predetermined distance, it is hard to precisely perform the upward casting take-out operation with a conventional casting take-out apparatus because positions of the sand molds are fluctuated by the activation and deactivation of the conveyor apparatus and the fluctuations occur especially in the transferring direction. The flaskless casting line of the first preferred embodiment has solved this problem by detecting the positions of the sprues 54 and accordingly determining the take-out positions, and enabled to precisely perform the upward casting take-out operation.

Since the flaskless casting line of the first preferred embodiment has the sand mold molding apparatus 9 which integrally forms the cavity of the sprue 54 and the cavity of the gate 56 to be taken out in a predetermined relative positional relationship, it furthermore effects the following additional advantages.

(9) Castings of various configurations can be securely taken out by an identical action from various sand molds whose cavity configurations vary each other.

Further, in a flaskless casting line for casting various kinds of products, it is necessary to precisely detect a position of a gate to be taken out, especially the position thereof in a transferring direction, in order to securely take out the castings of various configurations from the sand molds and perform the following handling operation. In view of this, it is the easiest and most precise way to always dispose the sprue and the gate to be taken out in a predetermined positional relationship, detect a position of the sprue and determine a position of the gate to be taken out from the position of the sprue detected.

Since the flaskless casting line of the first preferred embodiment removes the high band noise components with the low-pass filter 6 before digitizing the sand mold top surface temperature signal "V" output from the sand mold top surface temperature measuring apparatus 3 with the threshold voltage "Vt" to extract the high temperature band "Sm," the both ends of the high temperature band "Sm" can be determined precisely and accordingly the sprue center position "m" can be determined precisely.

Figure 19:
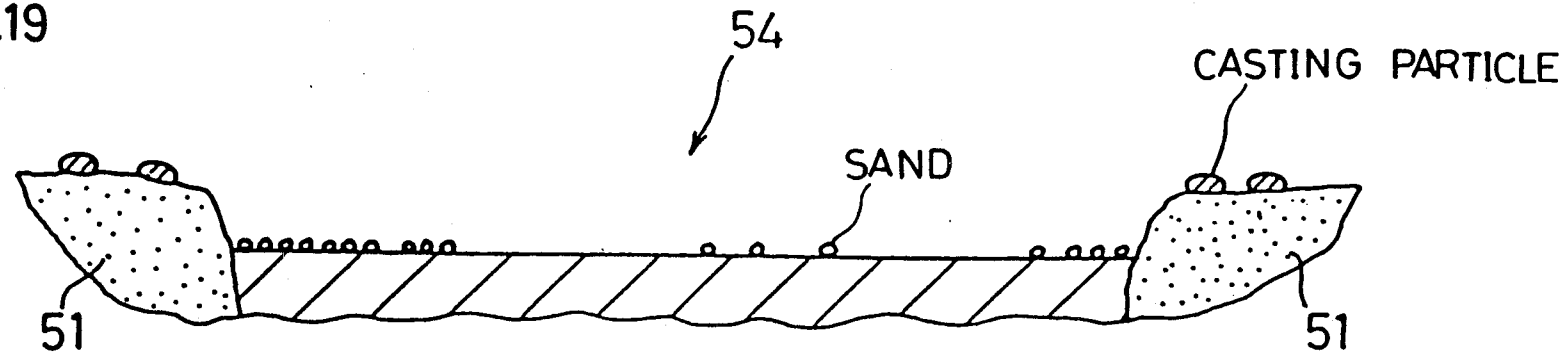
FIG. 19 is an enlarged schematic cross sectional view of a sprue 54 of a sand mold 51 of a sand mold row 5 of the flaskless casting line of the fourth preferred embodiment.
Figure 20:
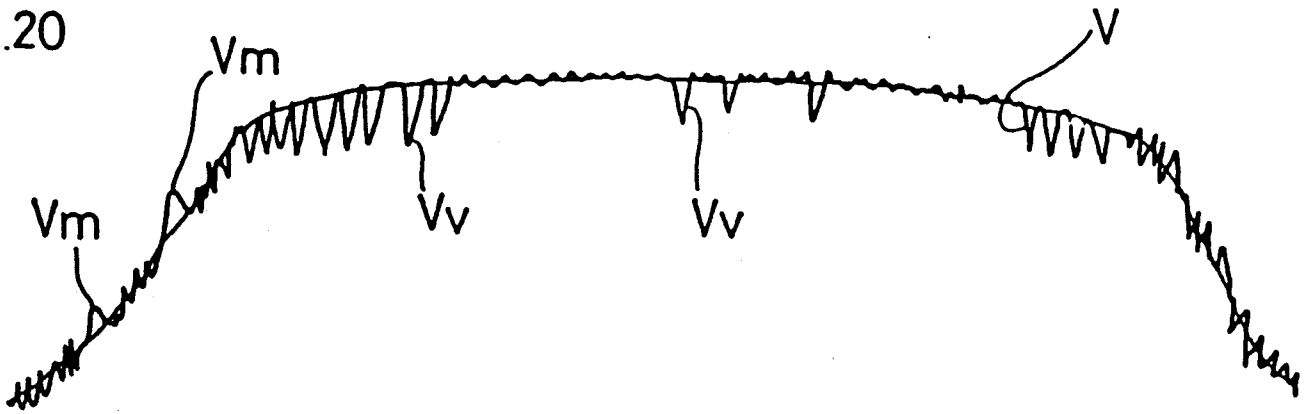
FIG. 20 is a partially enlarged waveform diagram of a sand mold top surface temperature signal "V" output from a sand mold top surface temperature measuring approximately 3 of the flaskless casting line of the fourth preferred embodiment.

Further, the boundary between the sprue 54 and the top surface of the sand mold 51 is substantially the ends of the high temperature band "Sm," but it is hard to precisely detect the boundary. Namely, as illustrated in FIGS. 19 and 20, particles of the casting may scatter sometimes on the top surface of the sand mold 51 adjacent to the boundary because of the running molten metal, and particles of the sand may cover sometimes on the surface of the sprue 54 adjacent to the boundary. Hence, the sand mold top surface temperature signal "V" may contain a small high temperature band "Vm" due to the running molten metal and a small low temperature band "Vv" due to the sprue 54 covered with the sand particles, and accordingly an intersection point of the boundary and the threshold voltage "Vt" may fluctuate. However, the inventors of the present invention have noticed that the small high temperature band "Vm" and the small low temperature band "Vv" have high frequency bands. Hence, the determination of high temperature bands "Sm" can be done precisely because the low-pass filter 6 shuts off the small high temperature band "Vm" and the small low temperature band "Vv" in the first preferred embodiment.

Namely, the flaskless casting line of the first preferred embodiment extracts the sprue center position "m" after the low-pass filter 6 has removed the high band noise components from the sand mold top surface temperature signal "V" output from the sand mold top surface temperature measuring apparatus 3, the both ends of the high temperature bands "Sm" can be determined precisely. As a result, the sprue center positions "m" can be determined precisely regardless of the molten metal running adjacent to the boundary between the sprue 54 and the top surface of the sand mold 51 or the sand covering the boundary.

Figure 14:
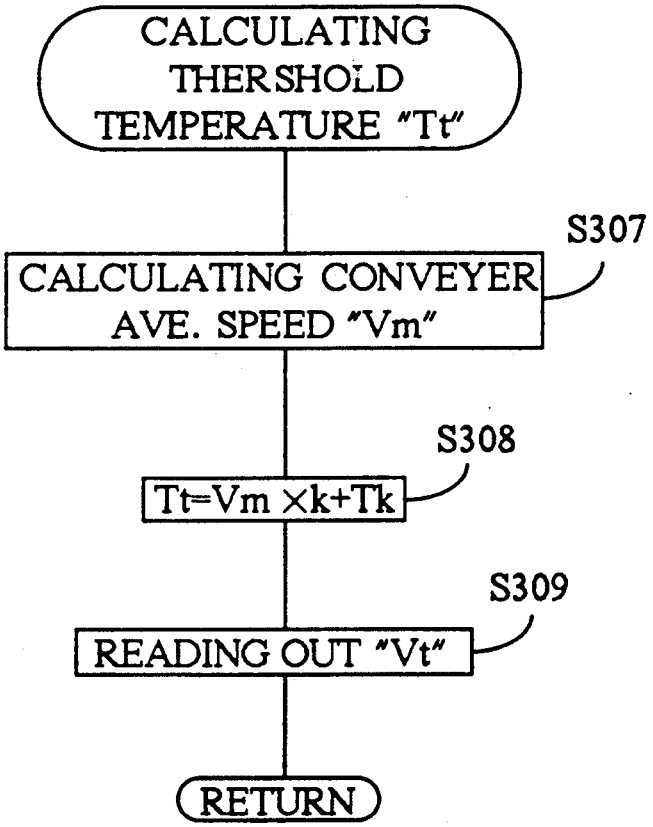
FIG. 14 is a flow chart illustrating an operation sequence of a microcomputer apparatus 4 of a flaskless casting line of a second preferred embodiment according to the present invention.

In addition, when the alternative sub-routine program for the threshold temperature calculation illustrated in FIG. 13 or 14 is employed in the flaskless casting line of the first preferred embodiment, it effects the following additional advantages.

(10) Since the threshold temperature "Tt" is correlated with the maximum temperature of the sprues 54 or the average temperature of the sand molds 51, there is an advantage that errors resulting from the temperature variations of the sprues 54 and the sand molds 51 can be made less in the measurement of the sprue center positions "m."

Specifically speaking, the sand mold top surface temperature is fluctuated by an abnormal conveyer speed, for instance, by troubles in a conveyer apparatus, sand mold molding and molten metal pouring. Further, a temperature of a sprue is decreased because sand molds are cooled when starting up a flaskless casting line. Furthermore, the sand mold top surface temperature is fluctuated by a room temperature difference between a summer period and a winter period. The sprue center position "m" may fluctuate when a maximum temperature of the high temperature band "Sm" is fluctuated by these environmental temperature variations.

Figure 9:
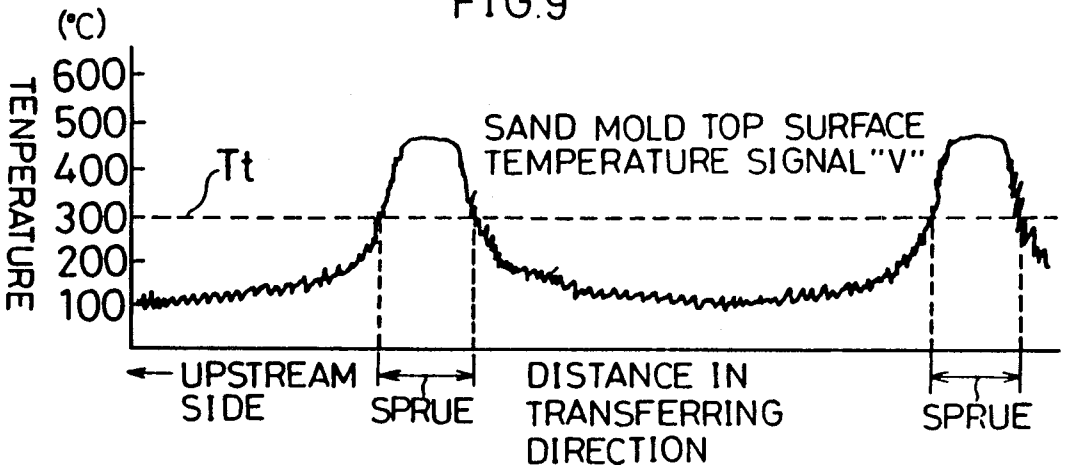
FIG. 9 is a diagram of a temperature distribution on top surfaces of sand molds of a flaskless sand mold row 5 at the end of the conveyer apparatus 1 of the flaskless casting line of the first preferred embodiment.
Figure 10:
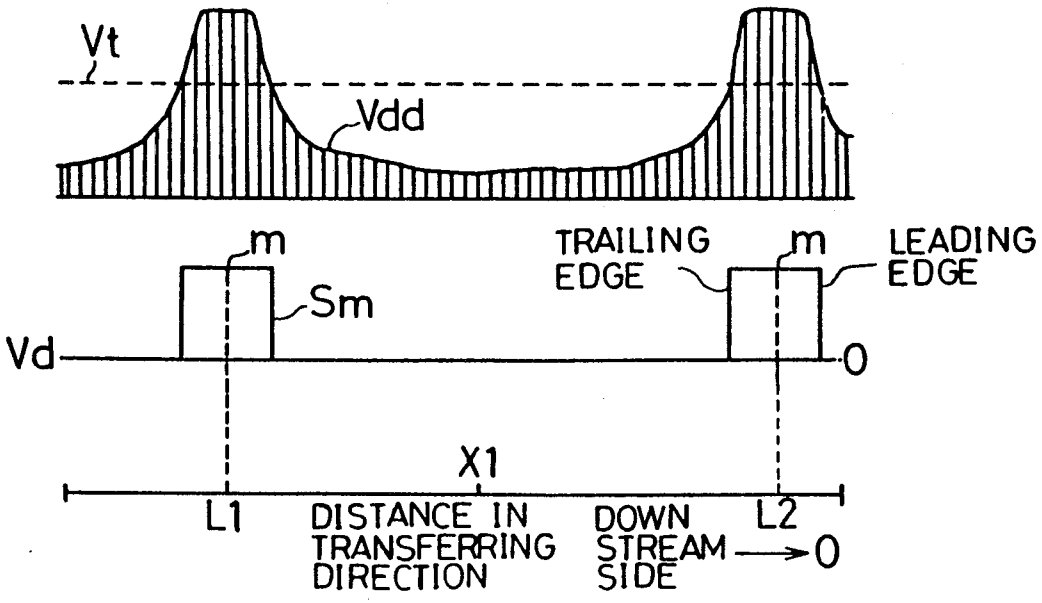
FIG. 10 is a signal waveform diagram illustrating signal waveforms output from peripheral devices of a microcomputer apparatus 4 of the flaskless casting line of the first preferred embodiment.

Namely, in the case that the center position of the high temperature band "Sm" is taken as the sprue center position "m" as illustrated in FIG. 9, even if the low band components "VL" of the sand mold top surface temperature signal "V" fluctuates against a predetermined threshold temperature, the sprue center position "m" is positioned at a predetermined position as far as the high temperature band "Sm" has a symmetrical waveform with respect to the sprue center position "m." However, the high temperature band "Sm" does not necessarily have a symmetrical waveform because of the presence of the high band noise components and the influence of the sprue configurations. Especially, in the case that the threshold voltage "Vt" intersects the leading edge or the trailing edge of the digital sand mold top surface temperature signal "Vdd" having a gentle gradient, the calculated sprue center position "m" fluctuates greatly. In addition, in the case that a position away from one end of the high temperature band "Sm" by a predetermined distance is regarded as the sprue center position "m," the above-mentioned fluctuations, such as the width variations of the high temperature band "Sm" and the like, have resulted in the errors in the sprue center position "m."

Hence, when the threshold temperature is correlated with the maximum temperature of the top surface (including the sprue 54) of the sand mold 51 or the average temperature of the top surfaces of the sand mold 51, the intersection position of the "Vdd" and the "Vt" is stabilized and consequently the errors in the detection of the sprue center position becomes less. The errors have resulted from the temperature variations in the sand molds 51 and the sprues 54. Since the fluctuations in the sand mold top surface temperature are correlated with the average value of the sand mold top surface temperatures, the fluctuations in the detection of the sprue center position "m" due to the above-mentioned causes can be suppressed by correlating the threshold temperature with the maximum temperature of the sand mold surface temperatures or the average temperature thereof.

Second Preferred Embodiment

A flaskless casting line of a second preferred embodiment according to the present invention will be hereinafter described with reference to FIG. 14. It is a modified version of the flaskless casting line of the first preferred embodiment, and employs a modified version of the sub-routine program for calculating the threshold temperature "Tt" at step "S30" in FIG. 11.

In the sub-routine program for calculating the threshold temperature "Tt," a conveyer average speed "Vm" is calculated first at step "S307" as illustrated in FIG. 14. The conveyer average speed "Vm" is calculated as follows: The sum (15.0 seconds) of one conveyer operation time (2.2 seconds) and one conveyer standby time (12.8 seconds) is multiplied by 180, i.e., a total number of the sand molds 51 to calculate an accumulated operation time "ΣTc," and the accumulated operation time "ΣTc" is divided by a distance from the molten metal pouring apparatus (not shown) to the sand mold top surface temperature measuring apparatus 3. Here, it is assumed that the distance from the molten metal pouring apparatus (not shown) to the sand mold top surface temperature measuring apparatus 3 is equal to the sum of the lenths of 180 pieces of the sand molds 51 in the transferring direction. An average speed of the sand mold 51 from the molten metal pouring apparatus (not shown) to the sand mold top surface temperature measuring apparatus 3 is thus calculated.

Then, a threshold temperature "Tt" is set in proportion to the conveyer average speed "Vm" at step "S308" by the following equation: $Tt = Vm \times K + Tk$, in which "K" is a proportional constant and "Tk" is a predetermined temperature. Further, a threshold voltage "Vt" corresponding to the threshold temperature "Tt" is generated and read out at step "S309." Here, the threshold temperature "Tt" is not necessarily in proportion to the average speed of the conveyer apparatus 1, but it has a positive correlation therewith.

As having been described so far, since the threshold temperature "Tt" is set in proportion to the average speed of the conveyer apparatus 1 in the flaskless casting line of the second preferred embodiment, the threshold temperature "Tt" can be adjusted in accordance with the temperature variations in the sand molds 51 resulting from abnormal conveyer speeds. As a result, the errors resulting from the variations in the conveyer speeds can be made less in the measurement of the sprue center positions "m."

Specifically speaking, when the conveyer speed is fluctuated, a maximum temperature of the high temperature band "Sm" is fluctuated and the sprue center position "m" is fluctuated accordingly. Namely, in the case that the center position of the high temperature band "Sm" is taken as the sprue center position "m" as illustrated in FIG. 9, even if the low band components "VL" of the sand mold top surface temperature signal "V" fluctuate against a predetermined threshold temperature, the sprue center position "m" is positioned at a predetermined position as far as the high temperature band "Sm" has a symmetrical waveform with respect to the sprue center position "m."

However, the high temperature band "Sm" does not necessarily have a symmetrical waveform because of the presence of the high band noise components and the influence of the sprue configurations. Especially, in the case that the threshold voltage "Vt" intersects the leading edge or the trailing edge of the digital sand mold top surface temperature signal "Vdd" having a gentle gradient, the calculated sprue center position "m" fluctuates greatly. In addition, in the case that a position away from one end of the high band temperature band "Sm" by a predetermined distance is regarded as the sprue center position "m," the above-mentioned fluctuations, such as the width variations of the high temperature band "Sm" and the like, have resulted in the errors in the sprue center position "m."

Hence, when the conveyer average speed "Vm" is correlated with the threshold voltage "Vt," the threshold voltages "Vt" follow the variations in the digital sand mold top surface temperature signal "Vdd" resulting from the conveyer speed fluctuations. As a result, the intersection position of the "Vdd" and the "Vt" is stabilized and the sprue center position "m" can be calculated precisely.

Third Preferred Embodiment

Figure 16:
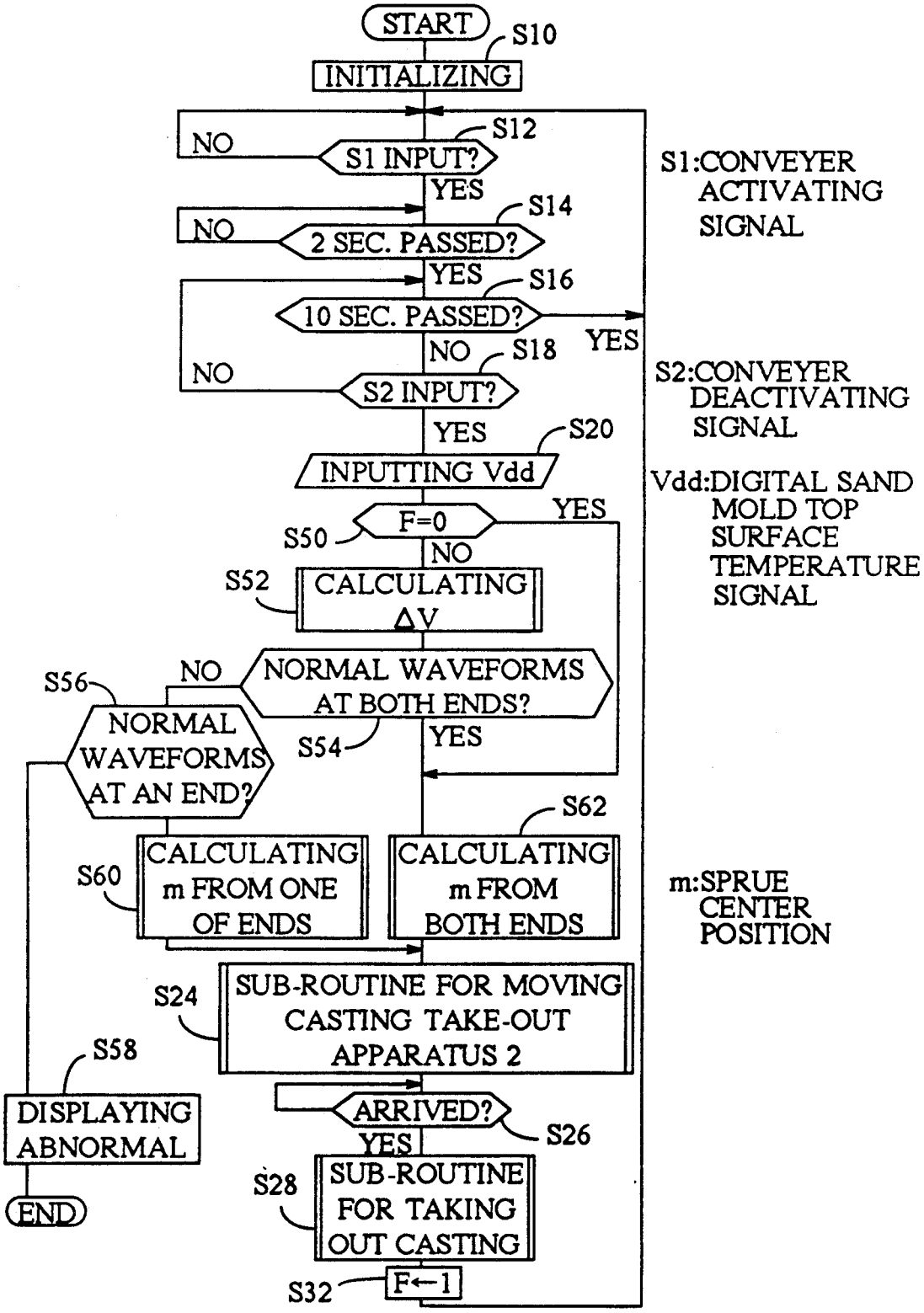
FIG. 16 is a flow chart illustrating an operation sequence of the microcomputer apparatus 4 of the flaskless casting line of the third preferred embodiment.
Figure 17:
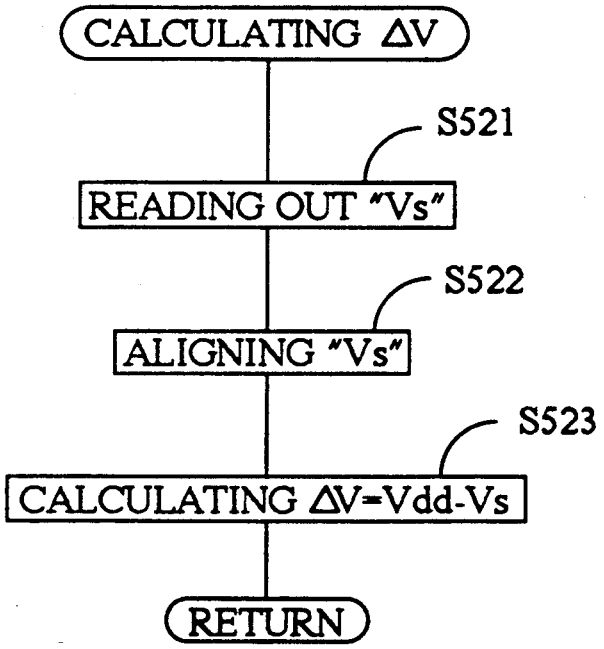
FIG. 17 is a flow chart illustrating another operation sequence of the microcomputer apparatus 4 of the flaskless casting line of the third preferred embodiment.

A flaskless casting line of a third preferred embodiment according to the present invention will be hereinafter described with reference to FIGS. 15 through 17. It is a modified version of the flaskless casting line of the first preferred embodiment, and employs a modified version of the main routine program for the microcomputer apparatus 4.

Figure 15:
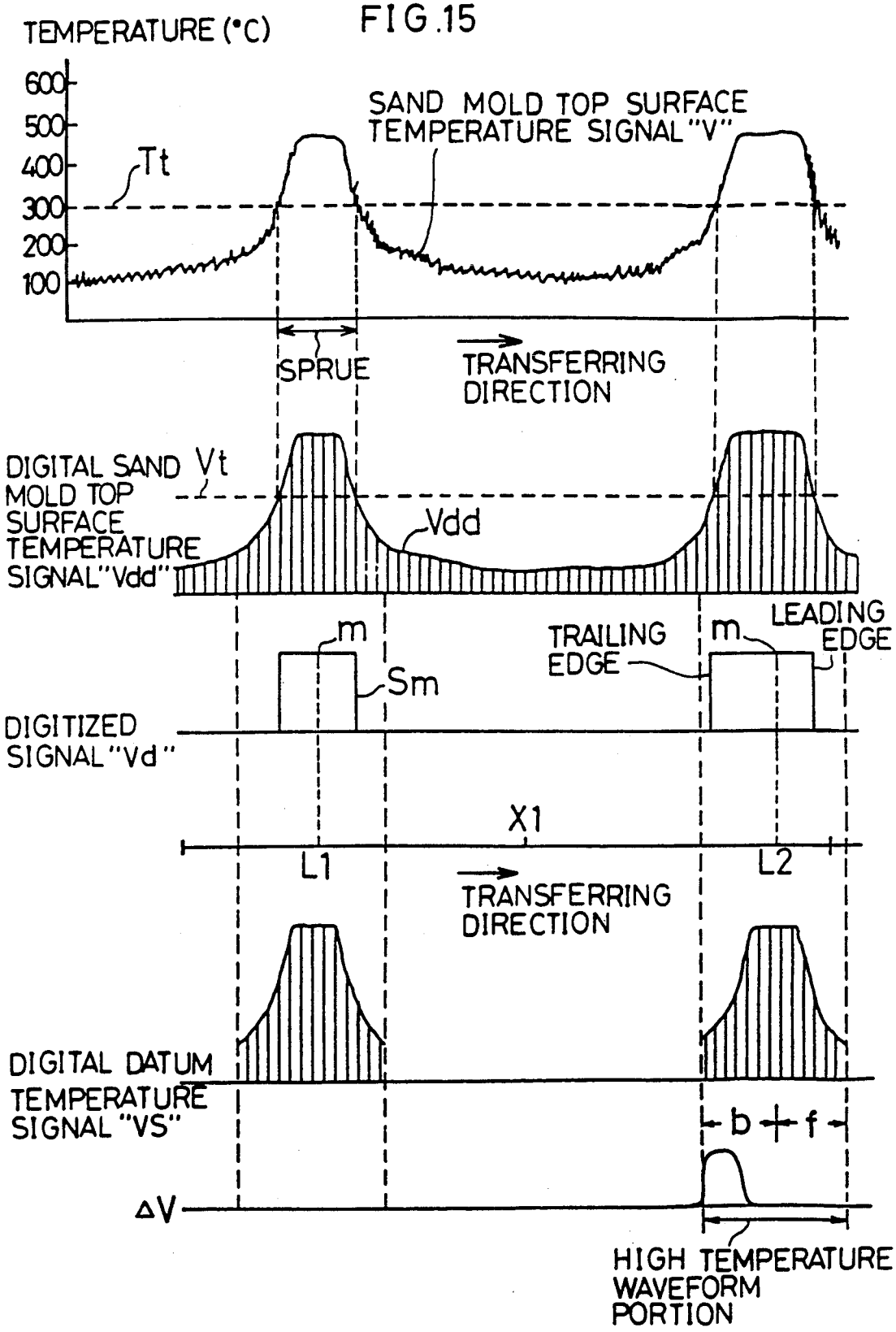
FIG. 15 is diagram of a temperature distribution on top surfaces of sand molds of a flaskless sand mold row 5 at an end of a conveyer apparatus 1 of a flaskless casting line of a third preferred embodiment and signal waveforms output from peripheral devices of a microcomputer apparatus 4 of the flaskless casting line of the third preferred embodiment.

In the third preferred embodiment, the microcomputer apparatus 4 has memorized a digital datum temperature signal "Vs" illustrated in FIG. 15 in advance. The digital datum temperature signal "Vs" is a standard waveform of the digital sand mold top surface temperature signal "Vdd." The microcomputer apparatus 4 compares the input digital sand mold top surface temperature signal "Vdd," especially a high temperature waveform portion thereof, with the digital datum temperature signal "Vs." When the difference between "Vdd" and "Vs" is remarkable, the microcomputer apparatus 4 judges that the digital sand mold top surface temperature is abnormal, and proceeds to carry out a special sprue center position determining operation later described.

The operation of the microcomputer apparatus 4 of the third preferred embodiment will be hereinafter described with reference to a flow chart in FIG. 16. Up to step "S20," the microcomputer apparatus 4 carries out the operations identical to those of the microcomputer apparatus 4 of the first preferred embodiment as illustrated in FIG. 11. At step "S50," the microcomputer apparatus 4 checks whether a flag "F" is 0. When the flag "F" is 0, the microcomputer apparatus 4 proceeds to step "S62," and carries out the sub-routine program for calculating the sprue center position "m," thereby calculating the coordinate positions "L1" and "L2" of the sprue center positions "m" (See FIG. 15.) in the transferring direction. Here, the coordinate positions "L1" and "L2" in the transferring direction specify distances from the sensor datum position "x1."

The sub-routine program is carried out as follows: The input digital sand mold top surface temperature signal "Vdd" is digitized into a digitized signal "Vd" with a predetermined threshold voltage "Vt" set in advance. Then, as illustrated in FIG. 15, the microcomputer apparatus 4 determines an intermediate point between a leading edge and a trailing edge of a high temperature band "Sm" as the sprue center position "m." Here, the high temperature band "Sm" corresponds to a level "1" area of the digitized signal "Vd." Further, as illustrated in FIG. 1, two sprue center positions "m" are detected for each of the image pick-up operations. However, when the sprue center position "m" is placed adjacent to the sensor datum position "x1," or a central position of the image pick-up area, one sprue center position "m" is detected for each of the image pick-up operations. In the former case, namely when two sprue center positions "m" are detected for each of the image pick-up operation, one of the sprue center positions "m" disposed on a downstream side in the transferring direction is regarded as the sprue center position "m" to be detected in the current detection operation. If an end of the high temperature band "Sm" (See FIG. 15.) overlaps one of the ends of the image pick-up area, the sprue center position "m" of the high temperature band "Sm" cannot be detected precisely. Accordingly, the sprue center position "m" of the other high temperature band "Sm," or the sprue area, disposed on an upstream side in the transferring direction is calculated if such is the case.

Then, at step "S24," the microcomputer apparatus 4 moves the casting take-out apparatus 2 by a distance ("L2"−"x1"), i.e., a difference between the coordinate position "L2" in the transferring direction calculated in the processing operation before the last and the sensor datum position "x1." The casting take-out apparatus 2 is moved in this manner because it is positioned on a downstream side by two pieces of the sand molds 51. When the microcomputer apparatus 4 judges that the casting take-out apparatus 2 arrives at the target position at step "S26," the microcomputer apparatus 4 has the casting take-out apparatus 2 carry out the above-mentioned casting take-out operation at step "S28." Then, the microcomputer apparatus 4 sets 1 to the flag "F" at step "S32," and returns to step "S12."

When carrying out the main routine program for the second time or later, since the flag "F" has been already set 1 at step "S50," the microcomputer apparatus 4 proceeds to step "S52," and carries out a sub-routine program for calculating the difference "ΔV" between the high temperature waveform portion of the input digital sand mold top surface temperature signal "Vdd" (See FIG. 15.) and the digital datum temperature signal "Vs" memorized in advance. Here, the digital datum temperature signal "Vs" is a standard wave form of the high temperature waveform portion of the input digital sand mold top surface temperature signal "Vdd."

The microcomputer apparatus 4 carries out the sub-routine program as hereinafter described with reference to FIG. 17. The microcomputer 4 first reads out the digital datum temperature "Vs" at step "S521," and assumes a position away from the previously calculated sprue center position "m" by "Lo," i.e., the nominal dimension of the sand mold 51 in the transferring direction, as a next standard sprue center position "m." Then, the microcomputer apparatus 4 aligns the standard sprue center position "m" with the sprue center position "m" of the digital datum temperature signal "Vs" in the transferring direction on a time axis, and disposes the digital datum temperature signal "Vs" in the direction of the time axis at step "S522." Thereafter, the microcomputer apparatus 4 calculates the differences "ΔV" between the digital sand mold top surface temperature signal "Vdd" and the digital datum temperature signal "Vs" at step "S523."

Then, in the case that an accumulated quantity of absolute values of the above "ΔV" in the front half "f" of the high temperature waveform portion of the digital sand mold top surface temperature signal "Vdd" found to be greater than a predetermined accumulated quantity (See FIG. 15.) at step "S54," the microcomputer apparatus 4 determines that the front half "f" is abnormal. Further, in the case that an accumulated quantity of absolute values of the above difference "ΔV" is the rear half "b" of the high temperature waveform portion of the digital sand mold top surface temperature signal "Vdd" is found to be greater than a predetermined accumulated quantity at step "S54," the microcomputer apparatus 4 determines that the rear half "b" is abnormal. When the front half "f" and the rear half "b" are found to be normal, the microcomputer apparatus 4 proceeds to step "S62." If not, the microcomputer apparatus 4 proceeds to step "S56."

At step "56," the microcomputer apparatus 4 checks whether either the front half "f" or the rear half "b" is normal. When either of them are found to be normal, the microcomputer apparatus 4 proceeds to step "S60" to carry out the sub-routine program for calculating the second sprue center position "m." When both of them are found to be abnormal, the microcomputer apparatus 4 proceeds to step "S58," outputs an abnormal alarm, and finishes the main routine program.

In a sub-routine program at step "S60," the microcomputer apparatus 4 memorizes a transferring direction coordinate of an edge (a leading edge or a trailing edge) of the high temperature band "Sm" belonging to either the front half "f" or the rear half "b" whichever is normal. For instance, as illustrated in FIG. 15, when the rear half "b" is covered with sand and found to be abnormal, the microcomputer apparatus 4 extracts a transferring direction coordinate of the leading edge of the high temperature band "Sm" of the digitized signal "Vd," the leading edge which belongs to the normal front half "f." Then, the microcomputer apparatus 4 sets a position away from the extracted leading edge by a predetermined distance "Lo/2" on an upstream side in the transferring direction as the sprue center position "m," and memorizes the transferring direction coordiante "L2." On the contrary, when the front half "f" is found to be abnormal and the rear half "b" is found to be normal, the microcomputer apparatus 4 extracts a transferring direction coordinate of the trailing edge of the high temperature band "Sm," the trailing edge which belongs to the normal rear half "b." Then, the microcomputer apparatus 4 sets a position away from the extracted trailing edge by a predetermined distance "Lo/2" on a downward side in the transferring direction as the sprue center position "m."

As having been described so far, the flaskless casting line of the third preferred embodiment compares the high temperature waveform portion of the digital sand mold top surface temperature signal "Vdd" with the digital datum temperature signal "Vs," i.e., the standard waveform. In the case that either the front half "f" or the rear half "b" of the high temperature waveform portion is normal, the microcomputer apparatus 4 determines a position away from either of the edges of the high temperature band "Sm" by a predetermined distance "Lo/2" as the sprue center position "m." Hence, when the sand covers the sprue 54 or the molten metal runs from the sprue 54, the flaskless casting line of the third preferred embodiment can detect the sprue center position "m" precisely as far as the half of the high temperature waveform is normal.

In short, when one of the leading waveform portions and the trailing waveform portions of the sand mold top surface temperature image is different from the standard waveform memorized in advance, the flaskless casting line of the third preferred embodiment determines the sprue center position from a normal waveform portion thereof. Hence, when the signal waveform is caused to be abnormal by the sand covering the sprue or the molten metal running from the sprue, the flaskless casting line can detect the sprue center position precisely.

Fourth Preferred Embodiment

A flaskless casting line of a fourth preferred embodiment according to the present invention will be hereinafter described with reference to FIGS. 18 through 20. It is a modified version of the flaskless casting line of the first preferred embodiment, and employs a modified version of the main routine program for the microcomputer apparatus 4.

The operation of the microcomputer apparatus 4 of the fourth preferred embodiment will be hereinafter described with reference to a flow chart in FIG. 18. Up to step "S20," the microcomputer apparatus 4 carries out the operations identical to those of the microcomputer apparatus 4 of the first preferred embodiment as illustrated in FIG. 11. At step "S50," the microcomputer apparatus 4 checks whether a flat "F" is 0. When the flag "F" is 0, the microcomputer apparatus 4 proceeds to step "S80," and carries out the sub-routine program for calculating the sprue center position "m," thereby calculating the coordinate positions "L1" and "L2" of the sprue center positions "m." in the transferring direction. The sub-routine program carried out at step "S80" is identical to the one carried out at step "S22" in FIG. 11.

Then, at step "S24," the microcomputer apparatus 4 moves the casting take-out apparatus 2 by a distance ("L2"− "x1"), i.e., a difference between the coordinate position "L2" in the transferring direction calculated in the processing operation before the last and the sensor datum position "x1." The casting take-out apparatus 2 is moved in this manner because it is positioned on a downstream side by two pieces of the sand molds 51. When the microcomputer apparatus 4 judges that the casting take-out apparatus 2 arrives at the target position at step "S26," the microcomputer apparatus 4 has the casting take-out apparatus 2 carry out the above-mentioned casting take-out operation at step "S28." Then, the microcomputer apparatus 4 sets 1 to the flag "F" at step "S32," and returns to step "S12."

When carrying out the main routine program for the second time or later, since the flag "F" has been already set 1 at step "S50," the microcomputer apparatus 4 proceeds to step "S70," and calculates an average temperature of the high temperature waveform portion of the digital sand mold temperature signal "Vdd," i.e., the sand mold average temperature according to the present invention.

Then, the microcomputer apparatus 4 carries out a sub-routine program for calculating a difference "ΔV" between the digital datum temperature signal "Vs" and the digital sand mold top surface temperature signal "Vdd" at step "S72." Namely, according to the sub-routine program, the microcomputer apparatus 4 searches and reads out the digital datum temperature signal "Vs" (See FIG. 15.) corresponding to the average temperature of the high temperature waveform portion, and aligns the read-out digital datum temperature signal "Vs" with the high temperature waveform portion of the digital sand mold top surface temperature signal "Vdd."

The sub-routine program for aligning the signals are carried out as follows. The microcomputer apparatus 4 assumes that a position away from the previously calculated sprue center position "m" by "Lo," i.e., the nominal dimension of the sand mold 51 in the transferring direction, as a next standard sprue center position "m." Then, the microcomputer apparatus 4 aligns the standard sprue center position "m" with the sprue center position "m" of the digital datum temperature signal "Vs" in the transferring direction on a time axis, and disposes the digital datum temperature signal "Vs" in the direction of the time axis. Thereafter, the microcomputer apparatus 4 calculates the differences "ΔV" between sand mold top surface temperature signal "Vdd" and the digital datum temperature signal "Vs."

Then, the microcomputer apparatus 4 checks whether an accumulated sum of absolute values of the above "ΔV" exceeds a predetermined threshold level and the digital sand mold top surface temperature "Vdd" is normal or not at step "S76." Here, as illustrated in FIGS. 19 and 20, when the sprue 54 is covered with sand, the "Vdd" is lower in temperature than the "Vs." When the molten metal runs on the top surface of the sand mold 51, the "Vdd" is higher in temperature than "Vs." In the case that the microcomputer apparatus 4 judges that the accumulated sum of the difference "ΔV" is the threshold level or less at step "S76," the microcomputer apparatus 4 judges that the "Vdd" is normal, and proceeds to step "S80." In the case that the microcomputer apparatus 4 judges that the accumulated sum of the difference "ΔV" exceeds the threshold level at step "S76," the microcomputer apparatus 4 judges that the "Vdd" is abnormal, and proceeds to step "S78."

In the sub-routine program at step "S78," the microcomputer apparatus 4 determines a position away from the sprue center position "m" calculated immediately before by "Lo," i.e., the nominal dimension of the sand mold 51 in the transferring direction, as the current sprue center position "m." The microcomputer apparatus 4 proceeds to step "S24," and thereafter carries out the operations similar to those described in the first preferred embodiment.

As having been described so far, the flaskless casting line of the fourth preferred embodiment determines the current sprue center position "m" from the sprue center position "m" calculated immediately before when it judges that the digital sand mold top surface temperature signal "Vdd" is abnormal. Accordingly, the casting take-out operation can be carried out without failure when the configurations of the sprues 54 are abnormal.

In addition, instead of calculating the current sprue center position "m" from the sprue center position "m" calculated immediately before, the current sprue center position "m" may be taken as a position away from the adjacent sprue center positions "m" by distances "2Lo," "3Lo," . . . and the like. Moreover, a plurality of the current sprue center positions "m" may be calculated from the adjacent sprue center positions "m," and an average of the plurality of the sprue center positions "m" may be determined as an authentic current sprue center position "m."

Fifth Preferred Embodiment

Figure 21:
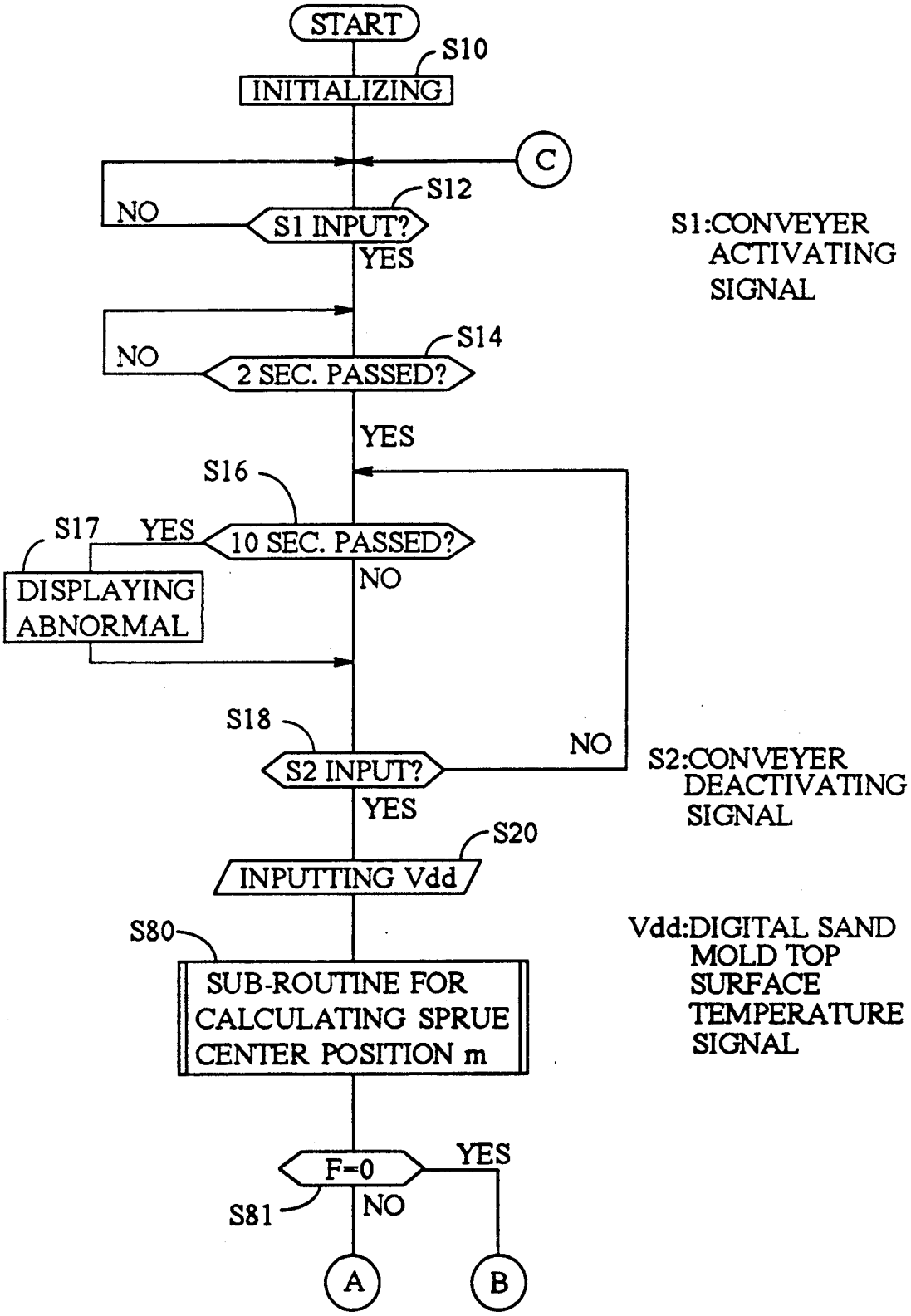
FIG. 21 is a flow chart illustrating an operation sequence of a microcomputer apparatus 4 of a flaskless casting line of a fifth preferred embodiment according to the present invention.
Figure 22:
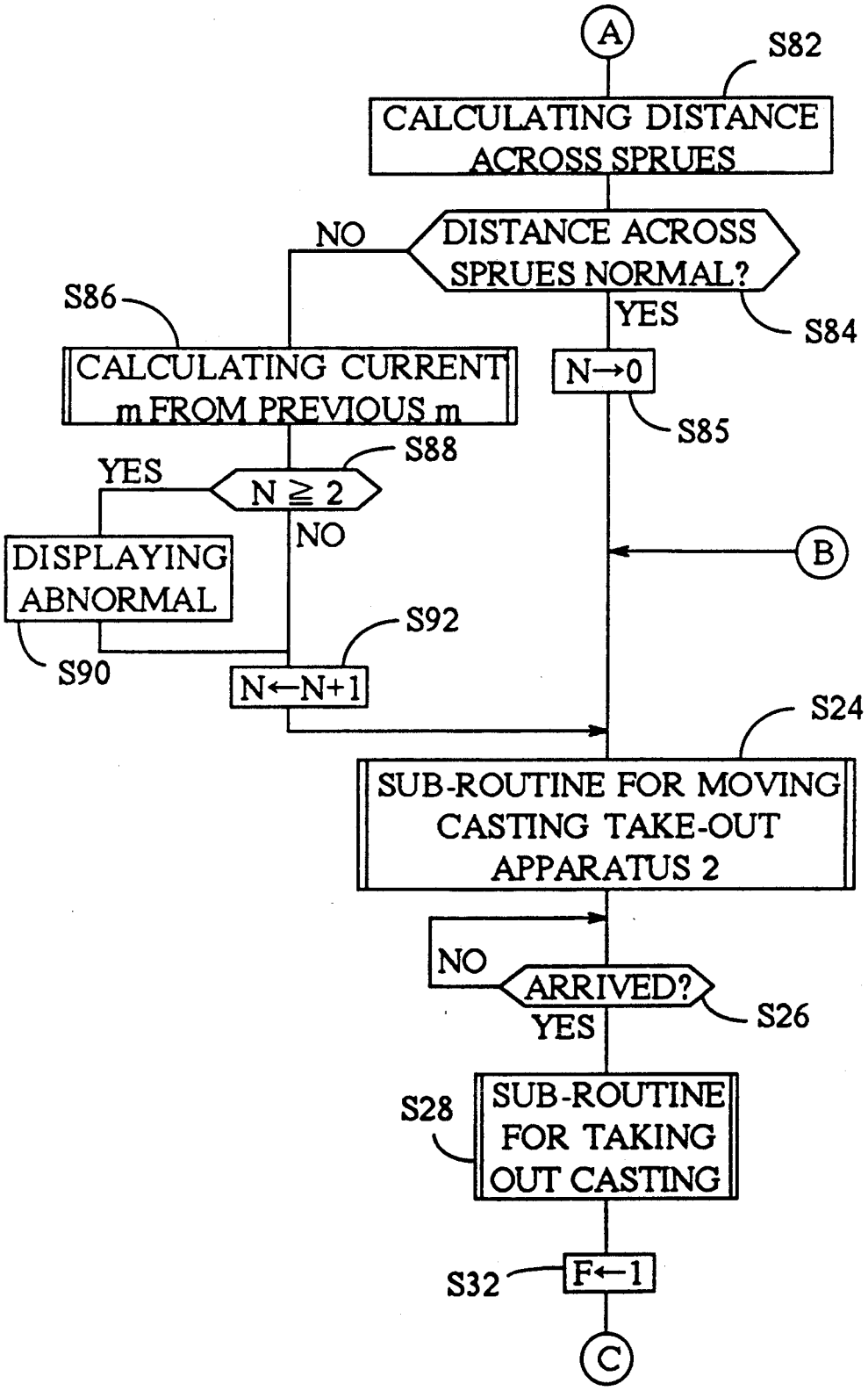
FIG. 22 is a flow chart illustrating another operation sequence of the microcomputer apparatus 4 of the flaskless casting line of the fifth preferred embodiment.

A flaskless casting line of a fifth preferred embodiment according to the present invention will be hereinafter described with reference to FIGS. 21 and 22. It is a modified version of the flaskless casting line of the first preferred embodiment, and differs from the first preferred embodiment in the operation of the microcomputer apparatus 4.

The operation of the microcomputer apparatus 4 will be hereinafter described in detail with reference to FIGS. 21 and 22. At first, the microcomputer apparatus 4 is initialized at step "S10," and put into a standby state until a conveyer activating signal "S1" is input at step "S12." When the microcomputer apparatus 4 is initialized, flags "F" and "N" later described are re-set to 0. Here, the conveyer activating signal "S1" and a conveyer deactivating signal "S2" are input into the microcomputer apparatus 4 by a central processing apparatus (not shown) which controls the conveyer apparatus 1. After the conveyer activating signal "S1" is input, the microcomputer apparatus 4 checks whether 2 seconds have passed thereafter at step "S14." Then, the microcomputer apparatus 4 checks whether 10 seconds have passed at step "S16" and whether the conveyer deactivating signal "S2" is input before 10 seconds have passed at step "S18." If such is the case, the microcomputer apparatus 4 proceeds to step "S20." If the microcomputer apparatus 4 judges that 10 seconds have passed and the conveyer deactivating signal "S2" has not input, it judges the conveyer activating signal "S1" input at step "S12" was an abnormal signal, proceeds to step "S17" to output an abnormal alarm signal, and eventually proceeds to step "S18." By carrying out the steps "S12" through "S16," it is possible to prevent the casting take-out apparatus 2 from being activated by abnormal signals other than the conveyer activating signal "S1" output during the predetermined operation at normal intervals.

Figure 18:
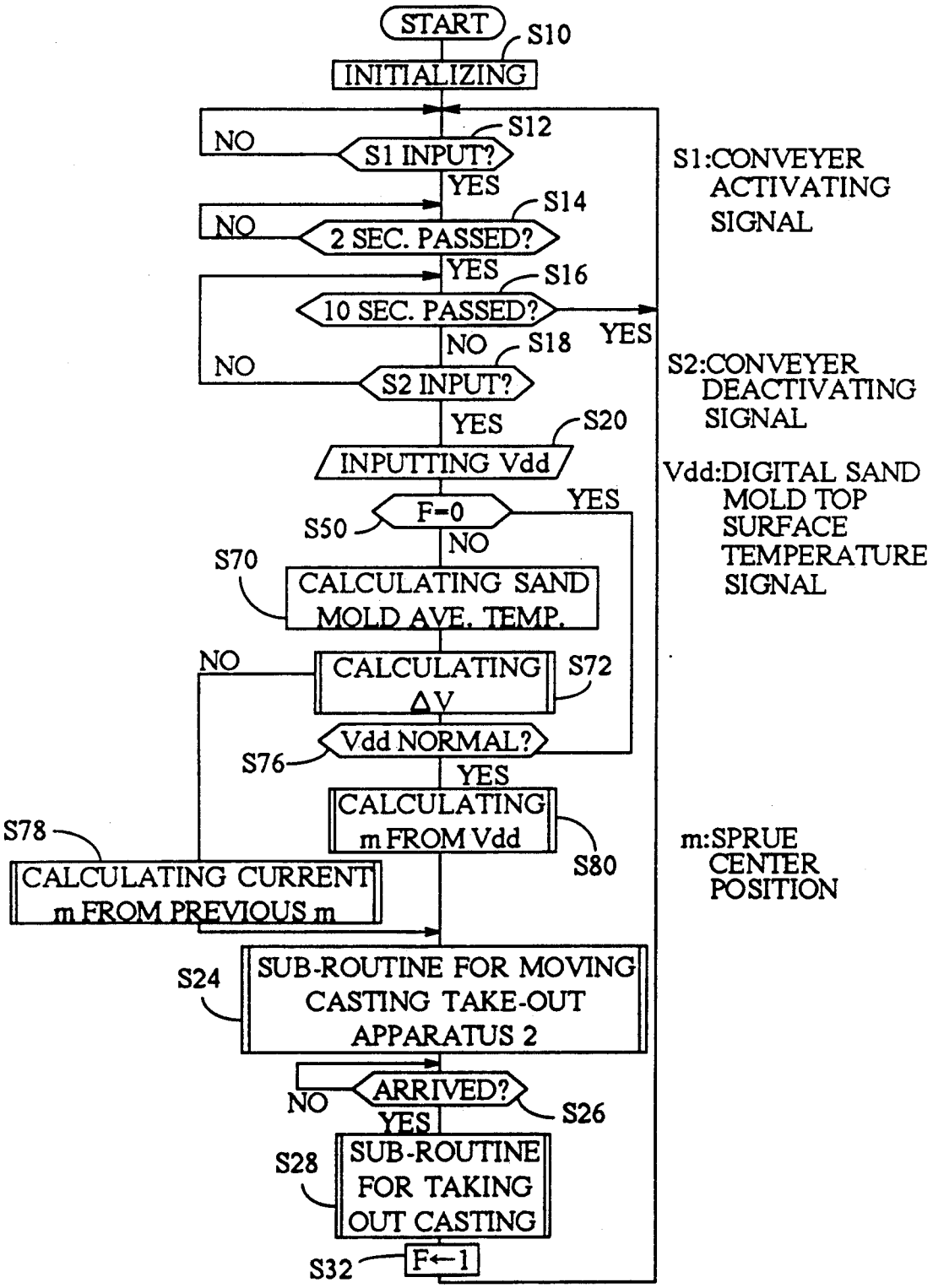
FIG. 18 is a flow chart illustrating an operation sequence of a microcomputer apparatus 4 of a flaskless casting line of a fourth preferred embodiment according to the present invention.

When the conveyer deactivating signal "S2" is input at step "S18," the microcomputer apparatus 4 receives the digital sand mold top surface temperature signal "Vdd" from the sand mold top surface temperature measuring apparatus 3 by way of the low-pass filter 6 and the A/D converter 7 at step "S20." The microcomputer apparatus 4 carries out the sub-routine program for calculating the sprue center position "m," thereby calculating the coordinate positions "L1" and "L2" of the sprue center positions "m" in the transferring direction at step "S80." Here, the coordinate position "L1" and "L2" in the transferring direction specify distances from the sensor datum position "x1," and the sub-routine program carried out to calculate the sprue center position "m" is identical to the one carried out at step "S80" of the fourth preferred embodiment illustrated in FIG. 18.

At step "S81," the microcomputer apparatus 4 checks whether the flag "F" is 0. When the flag "F" is 0, the microcomputer apparatus 4 proceeds to step "S24." Then, at step "S24," the microcomputer apparatus 4 moves the casting take-out apparatus 2 by a distance ("L2"−"x1"), i.e., a difference between the coordinate position "L2" in the transferring direction calculated in the processing operation before the last and the sensor datum position "x1." The casting take-out apparatus 2 is moved in this manner because it is positioned on a downstream side by two pieces of the sand molds 51. When the microcomputer apparatus 4 judges that the casting take-out apparatus 2 arrives at the target position at step "S26," the microcomputer apparatus 4 has the casting take-out apparatus 2 carry out the above-mentioned casting take-out operation at step "S28." Then, the microcomputer apparatus 4 sets 1 to the flag "F" at step "S32," and returns to step "S12."

When carrying out the main routine program for the second time or later, since the flag "F" has been already set to 1 at step "S81," the microcomputer apparatus 4 proceeds to step "S82" and calculates a distance between the sprues 54 from the current sprue center position "m" and the sprue center position "m" calculated immediately before in the operation of the main routine program last time (hereinafter simply referred to as a distance across the sprues 54).

Thereafter, the microcomputer apparatus 4 judges whether a difference between the calculated distance across the sprues 54 and a previously memorized datum distance across the sprues 54 is a predetermined value or less. When the difference is a predetermined value or less, the microcomputer apparatus 4 judges that the sprue center position "m" calculated this time is a normal one, and proceeds to step "S85," thereby re-setting 0 to the flag "N." Here, the flag "N" means a number of counts, and specifies a number of abnormal distances across the sprues 54 detected consecutively at step "S84."

When the distance across the sprues 54 is judged to be abnormal at step "S84," the microcomputer apparatus 4 assumes that the measurement of the distance across the sprues 54 was a failure, and proceeds to step "S86," thereby carrying out another sub-routine program for calculating the sprue center position "m." The another sub-routine program is carried out as follows. The current sprue center position "m" is regarded as a position which is disposed away from the sprue center position "m" calculated immediately before in the operation of the main routine program last time by the datum distance across the sprues 54 on a downstream side in the transferring direction. After carrying out the another sub-routine program, the microcomputer apparatus 4 proceeds to step "S88."

At step "S88," the microcomputer apparatus 4 checks whether the flag "N," or the number of counts, is 2 or more. When the flag "N" is not 2 or more, namely when the flag "N" is 0 or 1, the microcomputer apparatus 4 adds one to the flag "N" at step "S92," and proceeds to step "S24." When the flag "N" is 2 or more, namely when the abnormal distances across the sprues 54 are detected three times in a row, the microcomputer apparatus 4 judges that something abnormal happened in the arrangement of the positions of the sprues 54, outputs an abnormal alarm signal at step "S90," and eventually proceeds to step "S92."

As having been described so far, the flaskless casting line of the fifth preferred embodiment compares the distance across the sprues 54 currently calculated with the datum distance across the sprues 54. When the difference therebetween is greater than a predetermined value, the flaskless casting line assumes that the detection of the sprue center position "m" was failure, and regards a position away from the sprue center position "m" calculated immediately before by the datum distance across the sprues 54 as the current sprue center position "m."

In this manner, failure detections of the sprue center position "m" resulting from the sprue 54 covered with sand or the molten metal running around the sprue 54 can be corrected, and accordingly the operational efficiency of the flaskless casting line can be improved. In short, the flaskless casting line of the fifth preferred embodiment utilizes the fact that the fluctuations of the actual positions of the sprue 54 occur less than the failure detections due to the sprue 54 covered with sand or the molten metal running around the sprue 54.

In addition, in the fifth preferred embodiment, the current sprue center position "m" is set at a position away from the sprue center position calculated immediately before by the nominal dimension of one sand mold 51 in the transferring direction. However, as an alternative, it may be possible to set a position away from one of the neighboring sprue center positions "m" by "K×Lo," in which "K" is a positive integer, as the current sprue center position "m." Moreover, it may be possible to calculate a plurality of the current sprue positions "m" from the neighboring sprue center positions "m" and determine an authentic current sprue center position from an average position of the plurality of the current sprue positions "m."

Sixth Preferred Embodiment

Figure 23:
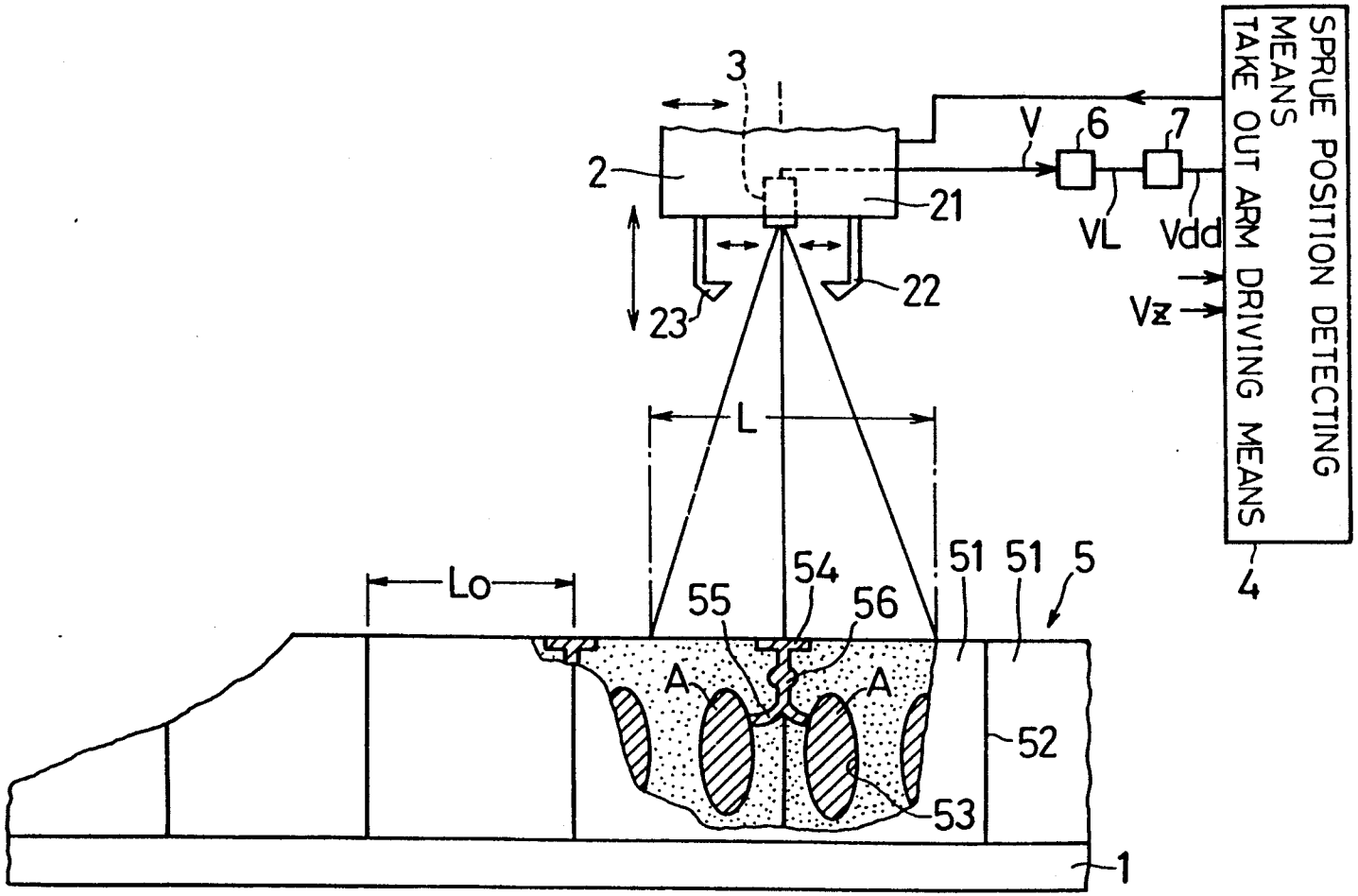
FIG. 23 a block diagram illustrating a sequence of a casting take-out operation carried out by a flaskless casting line of a sixth preferred embodiment according to the present invention.
Figure 24:
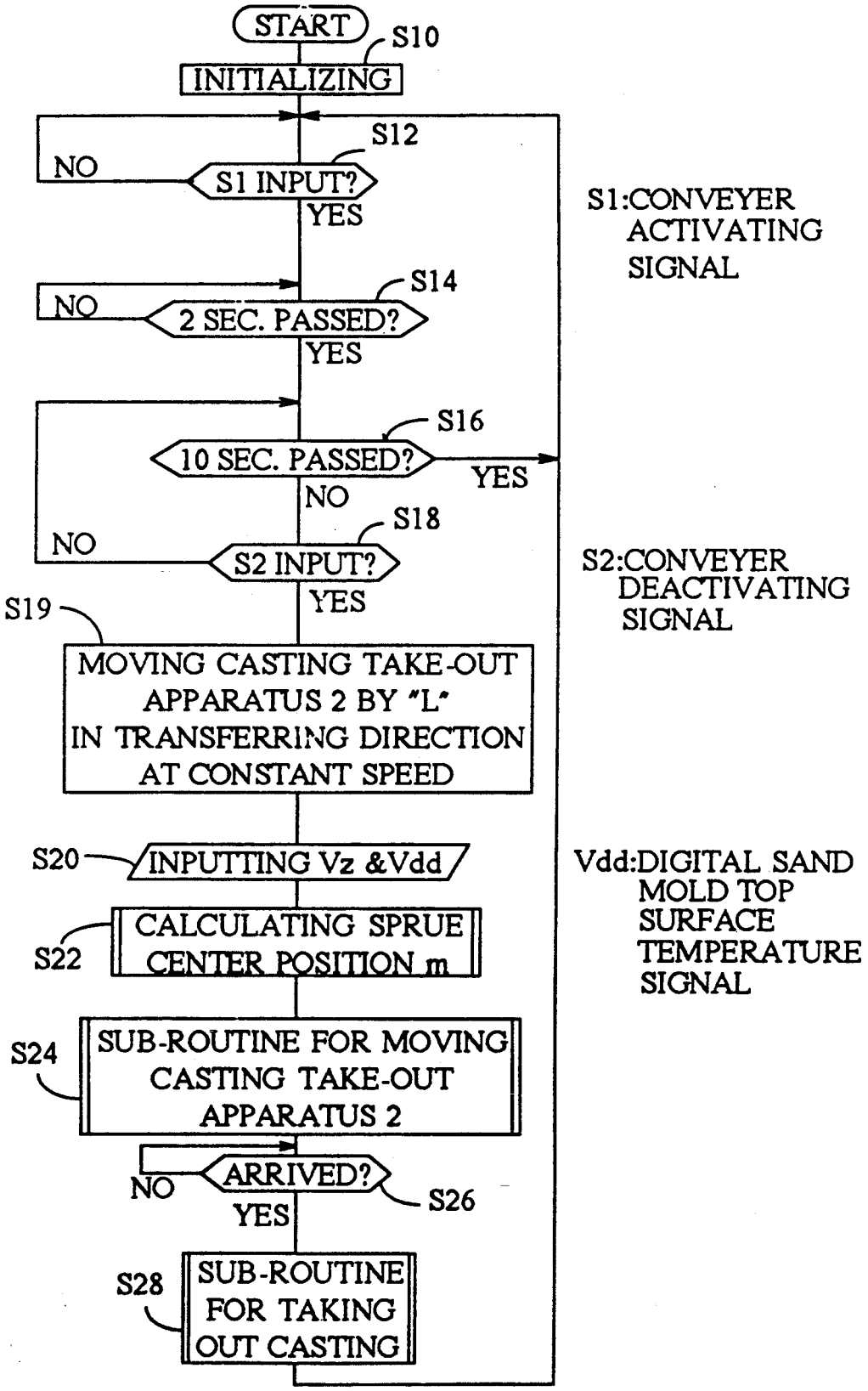
FIG. 24 is a flow chart illustrating an operation sequence of a microcomputer apparatus 4 of the flaskless casting line of the sixth preferred embodiment.

A flaskless casting line of a sixth preferred embodiment according to the present invention will be hereinafter described with reference to FIGS. 23 and 24. As illustrated in FIG. 23, it employs a sand mold top surface temperature measuring apparatus 3 whose radiation thermometer portion is fixed on a bottom surface of the casting take-out apparatus 2. The radiation thermometer portion is disposed downward above the central portion of the conveyer apparatus 1 in the right and left directions thereof. As the casting take-out apparatus 2 moves in the transferring direction, the radiation thermometer portion detects infrared radiations radiated from the sand mold top surfaces of the flaskless sand mold raw 5 consecutively in the transferring direction, and outputs a temperature of the sand mold 51 placed directly below to the microcomputer apparatus 4.

Therefore, the casting take-out apparatus 2 moves in the transferring direction by a distance "L" during the standby period of the conveyer apparatus 1, and consequently the sand mold top surface temperature measuring apparatus 3 picks up an image of the sand mold top surfaces of the flaskless sand mold raw 5 in the transferring direction by the distance "L" for each operation. The image pick-up distance "L" for each operation is set greater than the nominal dimension "Lo" of the sand mold 51 in the transferring direction, and at least one of the sprues 54 can be completely picked up by each of the image pick-up operations.

Further, according to an actual measurement, a temperature of the top surface of the sand mold 51 was 200° C. or less and a temperature of the sprue 54 was approximately 500° C. Hence, an infrared filter is employed in order to set a sensible wavelength band of the radiation thermometer portion in a range between 0.8 to 3 micrometers and more preferably in a range between 1 to 2 micrometers. These wavelength bands are favorable for identifying the sand and the sprue because the infrared energy radiated from the sand is extremely small in these wavelength bands.

The operation of the microcomputer apparatus 4 will be hereinafter described with reference to a flow chart illustrated in FIG. 24, Up to step "S18," the microcomputer apparatus 4 operates identically to that of the first preferred embodiment. When the conveyor deactivating signal "S2" is input at step "S18," the microcomputer apparatus 4 has the casting take-out apparatus 2 travel at a predetermined speed to an upstream side in the transferring direction by a distance "L" at step "S19." Here, the distance "L" is equal to "1.5Lo." The microcomputer apparatus 4 then receives the digital sand mold top surface temperature signal "Vdd" from the sand mold top surface temperature measuring apparatus 3 by way of the low-pass filter 6 and the A/D converter 7, and it also receives a signal "Vz" specifying a position of the casting take-out apparatus 2 in the transferring direction from an encoder (not shown) for outputting a current position of the casting take-out apparatus 2 simultaneously at step "S20."

The microcomputer apparatus 4 then processes the received digital sand mold top surface temperature signal "Vdd" and the casting take-out position signal "Vz" to calculate a central position of the sprue 54 in the transferring direction, namely the sprue center position "m" and coordinate positions "L1" and "L2" of the sprue center positions "m" in the transferring direction at step "S22." Here, the coordinate position "L1" and "L2" in the transferring direction specify distances from the sensor datum position "x1."

A sub-routine program is carried out as follows at step "S22" in order to calculate the above-mentioned sprue center position "m" and the like. Namely, the input digital sand mold top surface temperature signal "Vdd" is digitized into a digitized signal "Vd" with a predetermined threshold voltage "Vt." Then, the microcomputer apparatus 4 determines an intermediate point between a leading edge and a trailing edge of a high temperature band "Sm" as the sprue center position "m." Here, the threshold voltage "Vt" corresponds to the threshold temperature "Tt," i.e., 300° C. in this sixth preferred embodiment. Further, as illustrated in FIG. 23, two sprue center positions "m" are detected for each of the image pick-up operations. However, in certain cases, one sprue center position "m" is detected for each of the image pick-up operations. In the case that two sprue center positions "m" are detected for each of the image pick-up operations, one of the sprue center positions "m" disposed on a downstream side in the transferring direction is regarded as the sprue center position "m" to be detected in the current detection operation. If an end of the high temperature band "Sm" overlaps one of the ends of the image pick-up area, the sprue center position "m" of the high temperature band "Sm" cannot be detected precisely. Accordingly, if such is the case, the sprue center position "m" of the other high temperature band "Sm," or the sprue area, disposed on an upstream side in the transferring direction is calculated.

Then, the microcomputer apparatus 4 moves the casting take-out apparatus 2 in the transferring direction so that the central point of the casting take-out apparatus 2 is placed above the calculated sprue center position "m" at step "S24." When the microcomputer apparatus 4 judges that the casting take-out apparatus 2 arrives at the target position at step "S26," the microcomputer apparatus 4 has the casting take-out apparatus 2 carry out the above-mentioned casting take-out operation at step "S28."

Although the flaskless casting line of the six preferred embodiments employs a type of the sand mold top surface sensor which measures a temperature of a point on the sand mold top surface in a non-contact manner, it may employ an infrared linear image sensor and have the infrared linear image sensor pick up an image of the sand mold top surface by the distance "L" in the transferring direction at once during the standby period of the conveyer apparatus 1. Moreover, the flaskless casting line may employ a magnetic sensor or a ultrasonic sensor for the sand mold top surface temperature measuring apparatus 3, i.e., the sand mold top surface sensor.

As having been described so far, since the flaskless casting line of the sixth preferred embodiment has the sand mold top surface temperature measuring apparatus 3 disposed in the casting take-out apparatus 2, there occurs no fluctuation in the relative distance between the casting take-out apparatus 2 and the sand mold top surface temperature measuring apparatus 3 and there is no need to measure the relative distance between the casting take-out apparatus 2 and the sand mold top surface temperature measuring apparatus 3. To be concrete, there is no need to correct the sprue center position "m" determined in accordance with the sand mold top surface temperature signal "V" by the fluctuations in the relative distance between the casting take-out apparatus 2 and the sand mold top surface temperature measuring apparatus 3. In addition, since the casting take-out apparatus 2 can be travelled simultaneously with the detection of the sprue center position "m," the occurrence of errors in the measurement can be made minimum.

Seventh Preferred Embodiment

Figure 25:
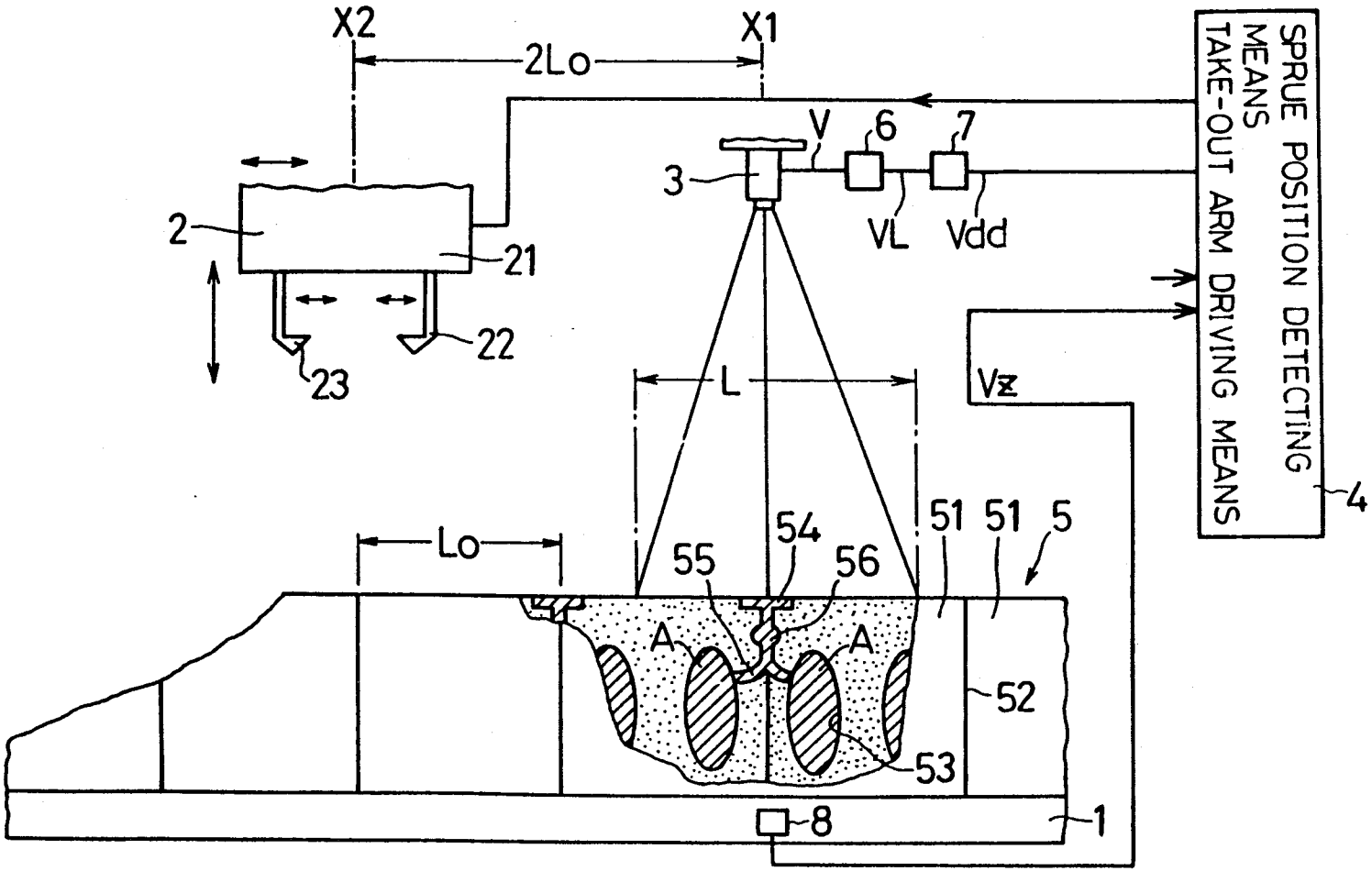
FIG. 25 is a block diagram illustrating a sequence of a casting take-out operation carried out by a flaskless casting line of a seventh preferred embodiment according to the present invention.
Figure 26:
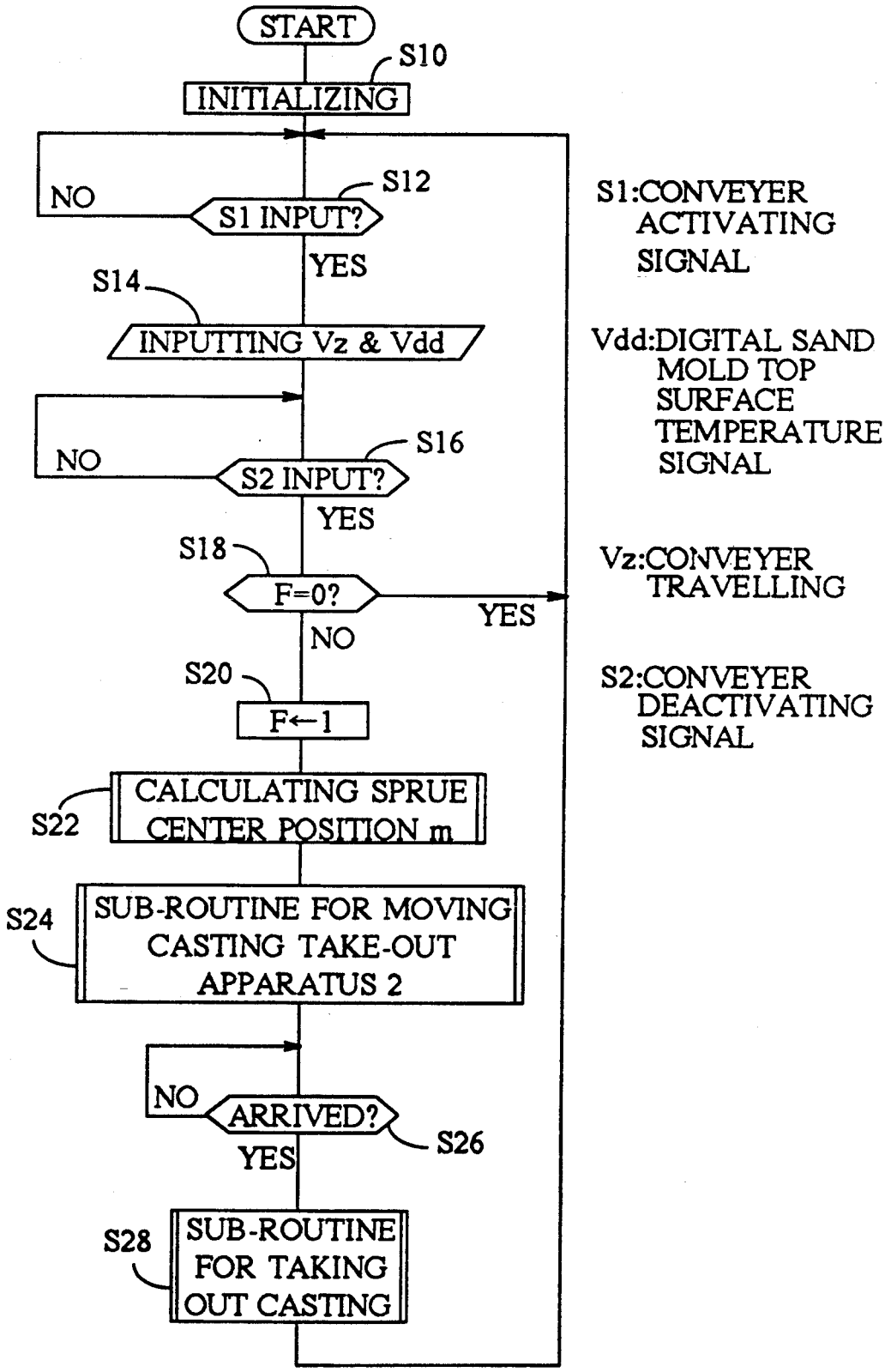
FIG. 26 is a flow chart illustrating an operation sequence of a microcomputer apparatus 4 of the flaskless casting line of the seventh preferred embodiment.

A flaskless casting line of a seventh preferred embodiment according to the present invention will be hereinafter described with reference to FIGS. 25 and 26. As illustrated in FIG. 25, it employs a conveyer travelling distance detection means 8 for detecting a conveyer travelling distance in addition to the arrangement of the first preferred embodiment.

The conveyer travelling distance detection means 8 includes a rotary encoder disposed directly below the sand mold top surface temperature measuring apparatus 3. The rotary encoder is connected to a rotary shaft of a roller (not shown) of the conveyer apparatus 1, and outputs a rotary angle of the rotary shaft as an angular signal "Vz" to the microcomputer apparatus 4. Since the weight of the flaskless sand mold row 5 allows to neglect the slippage between the roller and a belt (not shown) of the conveyer apparatus 1, a traveling distance of the conveyer apparatus 1 can be determined by detecting the rotary angle of the roller.

The operation of the microcomputer apparatus 4 will be hereinafter described with reference to a flow chart illustrated in FIG. 26. At first, the microcomputer apparatus 4 is initialized at step "S10," and put into a standby state until a conveyer activating signal "S1" is input at step "S12." Here, the conveyer activating signal "S1" and a conveyer deactivating signal "S2" are input into the microcomputer apparatus 4 by a central processing apparatus (not shown) which controls the conveyer apparatus 1. When the conveyer activating signal "S1" is input at step "S12," the microcomputer apparatus 4 receives the digital sand mold top surface temperature signal "Vdd" from the sand mold top surface temperature measuring apparatus 3 by way of the low-pass filter 6 and the A/D converter 7, and receives the conveyer travelling distance signal "Vz" from the conveyer travelling distance detection means 8 simultaneously at step "14."

Specifically speaking, the conveyer travelling distance detection means 8 outputs a pulsating conveyer travelling distance signal "Vz" each time the conveyer apparatus 1 travels by a small predetermined distance, the microcomputer apparatus 4 carries out sampling of the digital sand mold top surface temperature signal "Vdd" and memorizes the sampled sand mold top surface temperature signal "Vdd" sequentially in the memory area thereof each time the conveyer travelling distance signal "Vz" is input. Accordingly, the digital sand mold top surface temperature signal "Vdd" stored sequentially in the memory area for each of the measurements is made into a series of data measured at intervals in the transferring direction.

When the conveyer apparatus deactivating signal "S2" is input at step "S16," the microcomputer apparatus 4 checks a flag "F" at step "S18." The flag "F" specifies whether the data measured last time is saved in the memory area. When the flag "F" is 0 and the data measured last time is not saved in the memory area, the microcomputer apparatus 4 returns to step "S12." When the data measured last time is saved, the microcomputer apparatus 4 sets 1 to the flag "F," and processes the received digital sand mold top surface temperature signal "Vdd" to calculate a central position of the sprue 54 in the transferring direction, namely the sprue center position "m" and coordinate positions "L1" and "L2" of the sprue center positions "m" in the transferring direction at step "S22." Here, the coordinate positions "L1" and "L2" in the transferring direction specify distances from the sensor datum position "x1."

A sub-routine program is carried out as follows at step "S22" in order to calculate the above-mentioned sprue center position "m" and the like. Namely, the microcomputer apparatus 4 digitizes the digital sand mold top surface temperature signal "Vdd" for two travelling distances "2Lo" into the digitized signal "Vd" with a predetermined threshold voltage "Vt." Here, the digital sand mold top surface temperature signal "Vdd" for two travelling distances "2Lo" is the one synthesized from the digital sand mold top surface temperature signal "Vdd" memorized this time in the memory area (hereinafter simply referred to as a "current data") and the digital sand mold top surface temperature signal "Vdd" memorized last time during the operation period of the conveyer apparatus 1 (hereinafter simply referred to as a "previous data"). Then, the microcomputer apparatus 4 determines an intermediate point between a leading edge and a trailing edge of a high temperature band "Sm" as the sprue center position "m." Here, the high temperature band "Sm" corresponds to a level "1" area of the digitized signal "Vd," and the threshold voltage "Vt" corresponds to the threshold temperature "Tt," i.e., 300° C. in this seventh preferred embodiment. Further, as illustrated in FIG. 25, two sprue center positions "m" are detected for each of the image pick-up operations. However, when the sprue center position "m" is placed adjacent to the sensor datum position "x1," or a central position of the image pick-up area, one sprue center position "m" is detected for each of the image pick-up operations. In the former case, namely when two sprue center positions "m" are detected for each of the image pick-up operations, one of the sprue center positions "m" disposed on a downstream side in the transferring direction is regarded as the sprue center position "m" to be detected in the current detection operation. If an end of the high temperature band "Sm" overlaps one of the ends of the image pick-up area, the sprue center position "m" of the high temperature band "Sm" cannot be detected precisely. Accordingly, if such is the case, the sprue center position "m" of the other high temperature band "Sm," or the sprue area, disposed on an upstream side in the transferring direction is calculated.

Then, at step "S24," the microcomputer apparatus 4 moves the casting take-out apparatus 2 by a distance ("L2"−"x1"), i.e., a difference between the coordinate position "L2" in the transferring direction calculated in the processing operation before the last and the sensor datum position "x1." The casting take-out apparatus 2 is moved in this manner because it is positioned on a downstream side by two pieces of the sand molds 51. When the microcomputer apparatus 4 judges that the casting take-out apparatus 2 arrives at the target position at step "S26," the microcomputer apparatus 4 has the casting take-out apparatus 2 carry out the above-mentioned casting take-out operation at step "S28."

The flaskless casting line of the seventh preferred embodiment includes one sand mold top surface temperature measuring apparatus 3 provided on an upstream side with respect to the conveyer apparatus 1. However, it may include two sand mold temperature measuring apparatuses 3 which are disposed parallely to the transferring direction and placed adjacent to each other by less than one travelling distance "Lo." For instance, in the case that two sand mold top surface measuring apparatuses 3 are placed adjacent to each other by a half of the travelling distance "0.5Lo," the sand mold top surface temperature measuring apparatuses 3 can be made to measure one and a half travelling distances "1.5Lo" for one operation period of the conveyer apparatus 1 by synthesizing the sand mold top surface temperature signals "V" output from two sand mold top surface temperature measuring apparatuses 3. Accordingly, at least one sprue 54 can be measured completely. It is natural that more than two sand mold top surface temperature measuring apparatuses 3 may be disposed in series in the transferring direction.

Since the flaskless casting line of the seventh preferred embodiment measures the travelling distance of the conveyer apparatus 1 and detects the conditions at one point on the top surface of the sand mold 51 at the same time, there is no need to employ a linear image sensor or move the sand mold top surface temperature measuring apparatus 3. As a result, it is possible to simplify the arrangement of the flaskless casting line and improve the reliability and the measurement accuracy thereof.

Having now fully described the present invention, it will be apparent to one of ordinary skill in one art that many changes and modifications can be made thereto without departing from the spirit or scope of the invention as set forth herein.

What is claimed is:

1. A flaskless casting line comprising:

a conveyer means for intermittently transferring a flaskless sand mold row having a plurality of sand molds connected in a row in a transferring direction, said sand molds having a sprue;

a casting take-out means having a take-out arm for taking out a casting from said sand molds, said casting take-out means disposed at an end of said conveyer means;

a sand mold top surface sensor for detecting conditions of top surfaces of said sand moles, said sand mold top surface sensor disposed over said end of said conveyer means;

a sprue position detecting means for processing output signals of said sand mold top surface sensor and detecting a position of said sprue in said transferring direction; and a take-out arm driving means for moving said take-out arm of said casting take-out means to a casting take-out position calculated from said position of said sprue detected.

2. The flaskless casting line according to claim 1, wherein said take-out arm of said casting take-out means takes out said casting from said sand molds upward.

3. The flaskless casting line according to claim 2, wherein said take-out arm of said casting take-out means lifts up said casting at a gate thereof.

4. The flaskless casting line according to claim 1, wherein said sand mold top surface sensor is disposed on said casting take-out means being movable in said transferring direction.

5. The flaskless casting line according to claim 1, wherein said sand mold top surface sensor is disposed stationary on an upstream side with respect to said casting take-out means in said transferring direction and detects said conditions of said top surfaces of said sand molds at a point thereof, and said sprue position detecting means detects said position of said sprue in accordance with signals output by said sand mold top surface sensor during an operation period of said conveyer means.

6. The flaskless casting line according to claim 1, wherein said sand mold top sensor includes at least a sand mold top surface temperature measuring means for measuring a temperature distribution of said top surfaces of said sand molds, and said sprue position detecting means detects said position of said sprue from said temperature distribution of said top surfaces of said sand molds measured.

7. The flaskless casting line according to claim 1, wherein said sand mold top sensor includes at least a sand mold top surface image pick-up means for picking up an image of said top surfaces of said sand molds, and said sprue position detecting means detects said position of said sprue from said image of said top surfaces of said sand molds picked up.

8. The flaskless casting line according to claim 1, wherein said sand mold top sensor includes at least a magnetic sensor for detecting a magnetic characteristic of said top surfaces of said sand molds, and said sprue position detecting means detects said position of said sprue from said magnetic characteristic of said top surfaces of said sand molds detected.

9. The flaskless casting line according to claim 1, wherein said sprue position detecting means digitizes output signals of said sand mold top surface sensor with a predetermined threshold value set in advance, thereby circulating a sprue area and determining a center position of said sprue area in said transferring direction as said position of said sprue.

10. The flaskless casting line according to claim 8, wherein said sprue position detecting means digitizes output signals of said sand mold top surface sensor with a threshold value correlating with a maximum temperature portion of said temperature distribution of said top surfaces of said sand molds, thereby extracting a sprue area.

11. The flaskless casting line according to claim 8, wherein said sprue position detecting means digitizes output signals of said sand mold top surface sensor with a threshold value correlating with a maximum temperature of said temperature distribution of said top surfaces of said sand molds, thereby extracting a sprue area.

12. The flaskless casting line according to claim 1, wherein said sprue position detecting means determines a position away from a position of said sprue determined immediately before in said transferring direction by one standard transferring direction as a current position of said sprue when the sprue position detecting means determines that a distance between adjacent sprues differs from a standard distance between said sprue memorized in advance by a predetermined value or more.

* * * * *

UNITED STATES PATENT AND TRADEMARK OFFICE

CERTIFICATE OF CORRECTION

PATENT NO. : 5,101,880

DATED : April 7, 1992

INVENTOR(S) : Yoshikazu Fujiwara, Eiichi Tomita and Hiroshi Inoguchi

It is certified that error appears in the above-identified patent and that said Letters Patent is hereby corrected as shown below:

Column 4, line 41, please change "detected infrared" to --detects infrared--.

Column 6, line 15, please change "approximately 3" to --apparatus 3--.

Column 7, line 52, please change "fast that the" to --fact that the--.

Column 8, line 59, please change "approximately 3" to --apparatus 3--.

Column 9, line 47, please change "to precise the two" to --to pierce the two--.

Column 11, line 20, please change "threshold "Tmax" is" to --temperature "Tmax" is--.

Column 12, line 59, please change "positioning depend on" to --positions depend on--.

Column 18, line 2, please change "pick-up operation, one" to --pick-up operations, one--.

Column 18, line 55, please change "the differences" to --the difference--.

Column 18, line 67, please change "is the" to --in the--.

Column 19, line 43, please change "a downward side in" to --a downstream side in--.

Column 21, line 9, please insert --the digital-- before "sand".

Column 21, line 50, please change "away from the" to --away from--.

Column 26, line 56, please change "14" to --S14--.

Column 28, line 41, please change "in one art that" to --in the art that--

Column 30, line 10, please change "circulating a sprue area" to --calculating a sprue area--.

UNITED STATES PATENT AND TRADEMARK OFFICE

CERTIFICATE OF CORRECTION

PATENT NO. : 5,101,880

DATED : April 7, 1992

INVENTOR(S) : Yoshikazu Fujiwara, et. al.

It is certified that error appears in the above-indentified patent and that said Letters Patent is hereby corrected as shown below:

Column 30, line 23, please change "with a maxium temperature" to -- with an average temperature--.

Signed and Sealed this

Seventeenth Day of August, 1993

Bruce Lehman

*Attest:*

BRUCE LEHMAN

*Attesting Officer*

*Commissioner of Patents and Trademarks*